US011794943B2

(12) United States Patent
Sanchez

(10) Patent No.: US 11,794,943 B2
(45) Date of Patent: Oct. 24, 2023

(54) TRAY CONTAINER

(71) Applicant: Alonso Garcia Sanchez, Jalisco (MX)

(72) Inventor: Alonso Garcia Sanchez, Jalisco (MX)

( * ) Notice: Subject to any disclaimer, the term of this patent is extended or adjusted under 35 U.S.C. 154(b) by 0 days.

(21) Appl. No.: 17/669,796

(22) Filed: Feb. 11, 2022

(65) Prior Publication Data

US 2022/0388714 A1 Dec. 8, 2022

Related U.S. Application Data

(63) Continuation-in-part of application No. 17/337,780, filed on Jun. 3, 2021, now abandoned.

(51) Int. Cl.

| | |
|---|---|
| ***B65D 5/28*** | (2006.01) |
| ***B65D 5/20*** | (2006.01) |
| ***B65D 5/62*** | (2006.01) |
| ***B65D 77/20*** | (2006.01) |
| ***B65D 5/56*** | (2006.01) |

(52) U.S. Cl.

CPC ..... *B65D 5/28* (2013.01); *B65D 5/2047* (2013.01); *B65D 5/563* (2013.01); *B65D 5/62* (2013.01); *B65D 77/2024* (2013.01); *B65D 2577/20* (2013.01)

(58) Field of Classification Search

CPC ..... B65D 5/28; B65D 77/2024; B65D 5/563; B65D 85/345; B65D 5/4295

USPC ..... 229/174, 171, 181

See application file for complete search history.

(56) References Cited

U.S. PATENT DOCUMENTS

| | | | |
|---|---|---|---|
| 1,425,335 | A | 8/1922 | Peterson |
| 1,974,095 | A | 9/1934 | Barnes |
| 1,980,667 | A | 11/1934 | Daley |
| 2,065,804 | A | 12/1936 | Guyer |
| 2,859,905 | A | 11/1958 | Choate |
| 3,300,117 | A | 1/1967 | Kossnar |
| 3,316,102 | A | 4/1967 | Doll et al. |
| 3,550,835 | A | 12/1970 | Rune |
| 3,863,832 | A | 2/1975 | Gordon et al. |
| D248,278 | S | 6/1978 | Holden, Jr. |
| RE30,163 | E | 12/1979 | Meyer et al. |
| 4,183,458 | A | 1/1980 | Meyers |

(Continued)

FOREIGN PATENT DOCUMENTS

| | | |
|---|---|---|
| GB | 9008139240-0001 | 8/2020 |
| JP | 2003137246 | 5/2003 |
| PH | 32012119-0001 | 2/2012 |

OTHER PUBLICATIONS

Office Action, dated Aug. 12, 2021, from corresponding U.S. Appl. No. 17/337,780.

(Continued)

*Primary Examiner* — Ernesto A Grano

(74) *Attorney, Agent, or Firm* — Brient IP Law, LLC

(57) ABSTRACT

A tray container includes a paper-based material having a number of sides extending from a container bottom. Each side has a proximal end that is contiguous with the container bottom and a distal end that is configured to fold into a bonding surface and a reinforced portion. The bonding surface and the reinforced portion each include two layers of the container material. The tray container has a perimeter bonding surface that includes each bonding surface of the container sides. A support ring is attached to the perimeter bonding surface, defining a cover bonding surface to which a film or mesh cover may be bonded.

4 Claims, 33 Drawing Sheets

(56) References Cited

U.S. PATENT DOCUMENTS

| | | | | |
|---|---|---|---|---|
| 4,199,097 | A | 4/1980 | Christensson | |
| 4,949,847 | A | 8/1990 | Nagata | |
| 5,244,145 | A | 9/1993 | Forbes, Jr. | |
| 5,418,008 | A | 5/1995 | Calvert | |
| 5,425,972 | A | 6/1995 | Calvert | |
| 5,433,374 | A | 7/1995 | Forbes, Jr. | |
| 5,540,350 | A * | 7/1996 | Lansky | A47G 19/2211 220/713 |
| 5,820,908 | A | 10/1998 | Li | |
| D430,023 | S | 8/2000 | Shurtleff et al. | |
| 6,273,610 | B1 | 8/2001 | Koyama et al. | |
| D512,631 | S | 12/2005 | Lhoste et al. | |
| D548,069 | S | 8/2007 | Sagel et al. | |
| 7,597,242 | B2 | 10/2009 | Covelli | |
| D603,256 | S | 11/2009 | King | |
| D688,363 | S | 8/2013 | Dios | |
| D698,238 | S | 1/2014 | De Pra | |
| D742,218 | S | 11/2015 | Astorga et al. | |
| D756,167 | S | 5/2016 | Dudek et al. | |
| 9,469,432 | B2 | 10/2016 | Aguirre | |
| D804,299 | S | 12/2017 | Furuse et al. | |
| 10,232,973 | B2 | 3/2019 | Burke | |
| 10,336,500 | B2 | 7/2019 | Burke | |
| D886,529 | S | 6/2020 | Nelson | |
| 2004/0238403 | A1 | 12/2004 | Wright et al. | |
| 2006/0006215 | A1 | 1/2006 | Chen | |
| 2007/0045323 | A1 * | 3/2007 | Kroiss | A61J 19/00 220/495.06 |
| 2014/0246351 | A1 * | 9/2014 | Kobayashi | A47G 19/2205 206/524.6 |
| 2017/0105558 | A1 * | 4/2017 | Andreas | A47G 19/2261 |
| 2018/0194520 | A1 * | 7/2018 | Lovern | A01N 25/34 |
| 2018/0265274 | A1 | 9/2018 | Damarell et al. | |
| 2020/0262637 | A1 | 8/2020 | Tattam | |
| 2020/0324933 | A1 | 10/2020 | Greenfeld | |

OTHER PUBLICATIONS

Office Action, dated Dec. 7, 2022, from corresponding U.S. Appl. No. 29/763,638.

Premium Grape Tomatoes—10oz—Good & Gather Target. Date first available: 2021. Site visited: Nov. 29, 2022. Available online: https://www.target.com/p/premi um-grape-tomatoes-1 0oz-good-38-gather-8482-packaging-may-vary/-/ A-82667184 (Year: 2021).

Punnet with Resealable Lid. Date posted: Oct. 10, 2017. Site visited: Nov. 29, 2022. Available online: https://www.youtube.com/watch?v =vNT0yjVY-rM (Year: 2017).

Sustainable Produce Containers Keep Bad Things from Happening on YouTube. Date posted: Sep. 10, 2018. Site visited: Nov. 29, 2022. Available online: https://www.youtube.com/watch?v=hMn-_zTVxew (Year: 2018).

Office Action, dated Mar. 2, 2023, from corresponding U.S. Appl. No. 29/763,638.

* cited by examiner

TRAY CONTAINER

CROSS-REFERENCE TO RELATED APPLICATION

This application is a continuation-in-part of U.S. patent application Ser. No. 17/337,780, filed Jun. 3, 2021, entitled, "TRAY CONTAINER", and the disclosure of which is hereby incorporated by reference in its entirety.

BACKGROUND

Fruits and vegetables are often sold in specialized packaging that is designed to allow the produce to remain fresh and visually appealing until sold and consumed. Packaging may be plastic or polymer-based, or may be primarily a paper-based material. While paper-based materials may be more environmentally friendly than polymer-based materials, packaging with paper presents challenges as compared to using plastic. Specifically, plastic containers and corresponding lids may be injection molded to any desired shape and configuration to create a sturdy package and lid combination. In contrast, paper-based containers are cut, folded, and glued into the final container shape. Lids or coverings such as films or open mesh material must be glued or otherwise bonded to the container. Paper may not provide adequate support for securing these coverings without utilizing undesirably thick paper-based material.

Consequently, there is a need for improved paper-based containers that provide structural attributes that allow for securing film, open mesh, and other coverings to be bonded to the container after positioning fruits or vegetables within. Various embodiments of the present tray container system recognize and address the foregoing considerations, and others, of prior art devices.

SUMMARY

It should be appreciated that this Summary is provided to introduce a selection of concepts in a simplified form that are further described below in the Detailed Description. This Summary is not intended to be used to limit the scope of the claimed subject matter.

According to one aspect of the disclosure, a tray container includes a container material that is foldable from an unassembled configuration that is substantially flat to an assembled container that defines an interior space within. The tray container has a container bottom and a number of container sides formed from the container material. Each side has a proximal end that is contiguous with the container bottom and a distal end that is configured to fold into a bonding surface and a reinforced portion. The bonding surface and the reinforced portion each include two layers of the container material. The tray container has a perimeter bonding surface that includes each bonding surface of the container sides. The tray container has a support ring configured for attachment to the perimeter bonding surface when the container material is folded in the assembled configuration. The support ring defines a cover bonding surface to which a cover may be bonded. The container material includes a first contiguous material and the support ring comprises a second contiguous material.

According to another aspect of the disclosure, a tray container includes a paper-based material that is foldable from an unassembled configuration that is substantially flat to an assembled container that defines an interior space within. The tray container has a container bottom and a number of container sides formed from the paper-based material. Each side has a proximal end that is contiguous with the container bottom and a distal end that is configured to fold into a bonding surface and a reinforced portion. The bonding surface and the reinforced portion each include two layers of the container material. The container sides include a first side, a second side opposite the first, a third side positioned between the first and second sides, and a fourth side opposite the third and between the first and second sides. The container has a perimeter bonding surface that includes each bonding surface of the four container sides. The tray container has a support ring configured for attachment to the perimeter bonding surface when the container material is folded in the assembled configuration. The support ring defines a cover bonding surface to which a cover may be bonded. The container material includes a first contiguous material and the support ring comprises a second contiguous material. The tray container further includes a cover that is bonded to the cover bonding surface of the support ring.

According to yet another aspect of the disclosure, a tray container includes a paper-based material that is foldable from an unassembled configuration that is substantially flat to an assembled container that defines an interior space within. The tray container has a container bottom and a number of container sides formed from the paper-based material. Each side has a proximal end that is contiguous with the container bottom and a distal end that is configured to fold into a bonding surface and a reinforced portion. The bonding surface and the reinforced portion each include two layers of the paper-based material. The reinforced portion of each container side comprises the distal end folded 180 degrees outward from the interior space and bonded to the container side to create the reinforced portion that is two layers in thickness and a distal reinforced end. The bonding surface of each container side includes the distal reinforced end folded outward from the interior space to create the bonding surface that is substantially coplanar with the container bottom. The tray container has a perimeter bonding surface that includes each bonding surface of the container sides. The tray container has a support ring configured for attachment to the perimeter bonding surface when the container material is folded in the assembled configuration. The support ring defines a cover bonding surface to which a cover may be bonded.

BRIEF DESCRIPTION OF THE DRAWINGS

Various embodiments of the disclosure will be described below. In the course of the description, reference will be made to the accompanying drawings, which are not necessarily drawn to scale, and wherein.

DETAILED DESCRIPTION OF VARIOUS EMBODIMENTS

Figure 1:
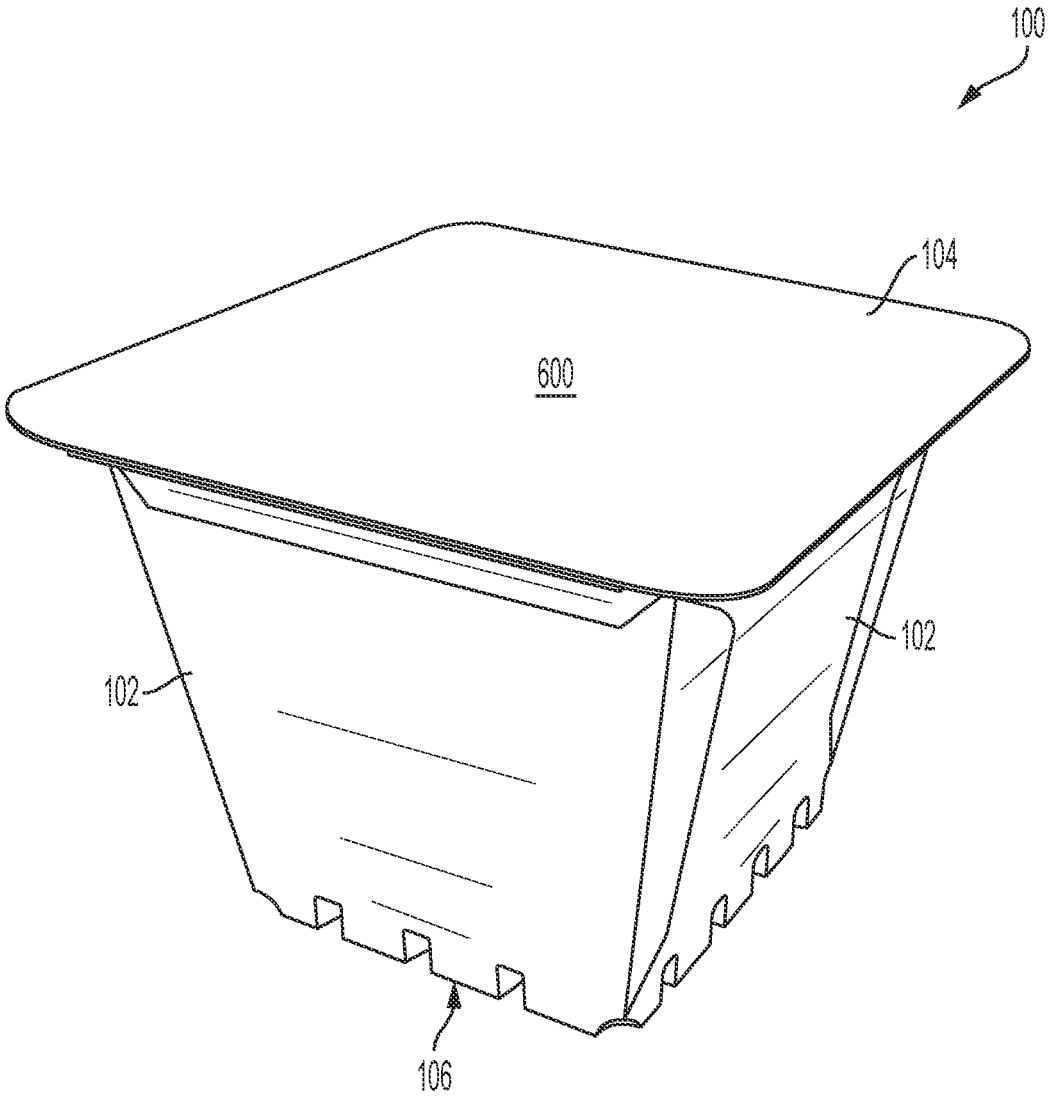
FIG. 1 is a front perspective view of a tray container having a film cover, according to various embodiments described herein.
Figure 2:
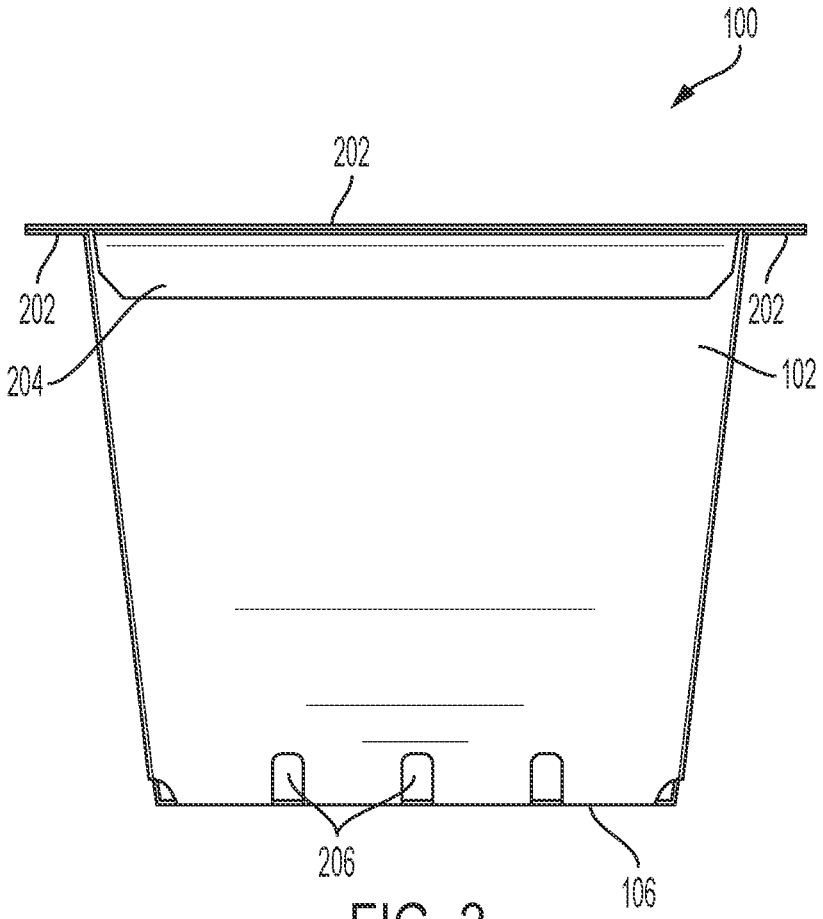
FIG. 2 is a front elevation view of a tray container having a film cover, according to various embodiments described herein.
Figure 3:
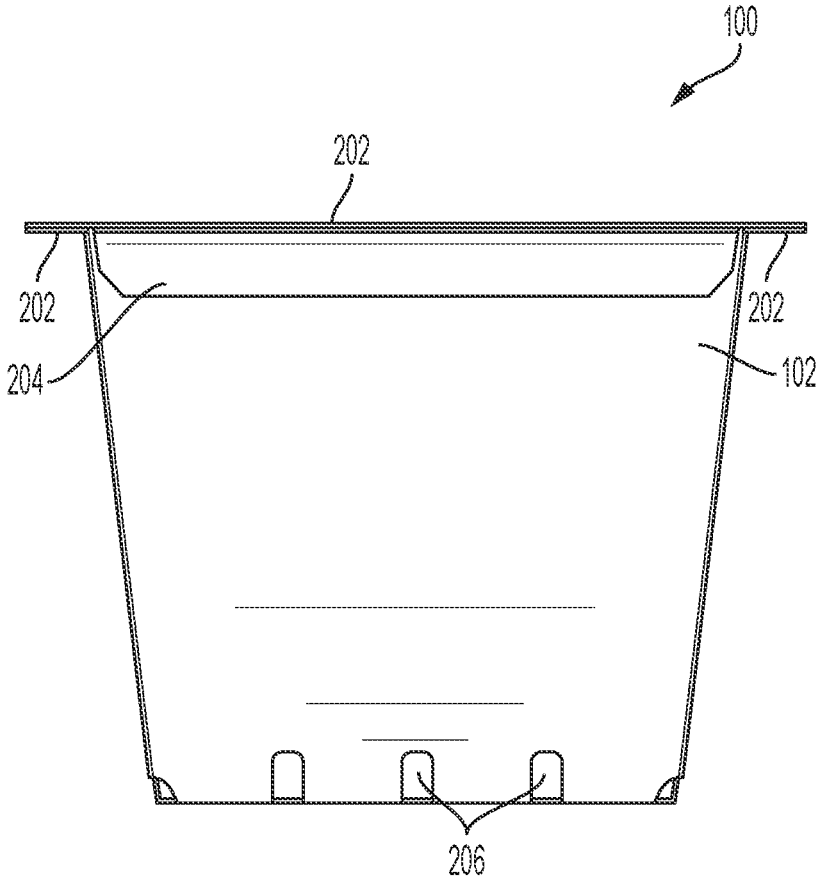
FIG. 3 is a rear elevation view of a tray container having a film cover, according to various embodiments described herein.
Figure 4:
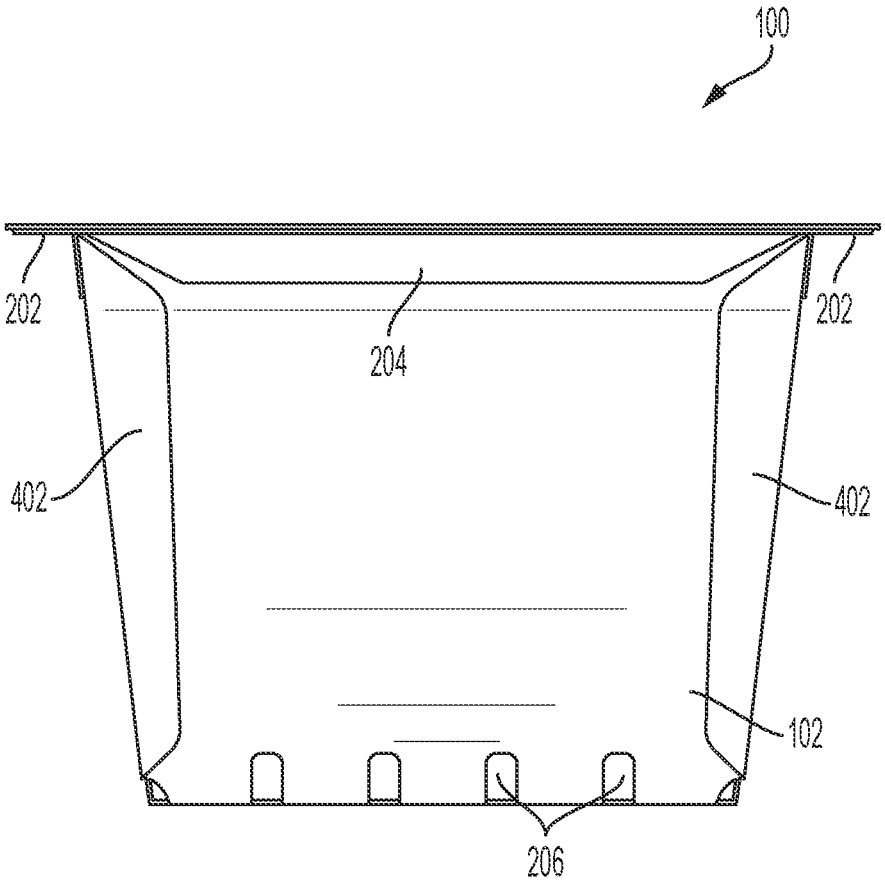
FIG. 4 is a left side elevation view of a tray container having a film cover, according to various embodiments described herein.
Figure 5:
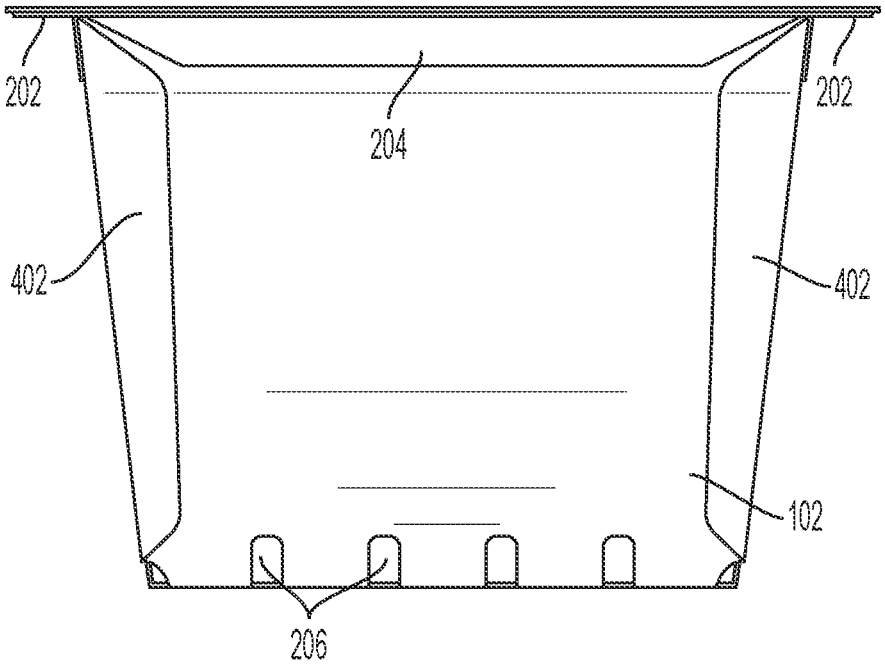
FIG. 5 is a right side elevation view of a tray container having a film cover, according to various embodiments described herein.

Various embodiments will now be described more fully hereinafter with reference to the accompanying drawings. It should be understood that the concepts disclosed herein may be embodied in many different forms and should not be construed as limited to the embodiments set forth herein. Rather, these embodiments are provided so that this disclosure will be thorough and complete, and will fully convey the scope of the disclosure to those skilled in the art. Like numbers refer to like elements throughout.

As discussed briefly above, paper products are more environmentally friendly than plastic. However, paper-based products provide challenges to creating containers that are suitably configured, maintain proper shape, and allow for a suitably rigid or stable surface to which various types of container covers to be secured. The concepts and technologies described herein provide a paper-based tray container that may be folded from a flat unassembled configuration to a four-sided or multiple-sided tray container having a reinforced perimeter bonding surface to which a film or mesh cover may be attached for securing fruits or vegetables inside.

Turning now to FIGS. 1-7, a first embodiment of a tray container will be described. FIGS. 1-7 show perspective, front, rear, left, right, top, and bottom views, respectively, of a tray container having a container cover in the form of a film cover according to one embodiment. An alternative embodiment of the tray container having a container cover in the form of a mesh cover is shown in FIGS. 8-14. The embodiments of FIGS. 1-7 and 8-14 will be discussed together, with a primary difference being the film cover of FIGS. 1-7 versus the mesh cover of FIGS. 8-14.

The tray container 100 generally includes 4 sides 102, a top 104, and a bottom 106, although additional or fewer sides could be utilized without departing from the scope of this disclosure. Each side 102 has a proximal end connected to the bottom 106 and a distal end defining a bonding surface 202 to which a cover may be secured. The material used for the tray container 100 may be paper-based, such as solid bleached sulfate (SBS) coated paper cardboard that is 8-24 points in thickness or alternatively 200 grams per square meter (gsm) to 400 gsm. The paper-based material may be coated with a food-grade wax material to improve structural characteristics of the container while providing an effective barrier between the food products within the container and relatively porous container material to inhibit bacterial and/or mold growth and to maintain freshness of the products.

Apertures 206 may be positioned within the sides 102 and/or bottom 106 of the tray container 100 as desired according to the type of fruits or vegetables to be stored inside the container. In the examples shown in the various drawings, the embodiment of FIGS. 8-14 utilizing a mesh cover is shown with additional apertures 206 positioned in the sides 102 of the container as compared with the embodiment of FIGS. 1-7 utilizing a film cover in order to provide for additional ambient air circulation throughout the container according to the requirements of the product stored within. Any type, number, shape and configuration of apertures 206 may be utilized with any embodiment of the tray container 100 disclosed herein to maximize, minimize, or direct the ambient airflow in and out of the tray container according to the ambient air requirements for the stored product.

As discussed briefly above, paper-based containers possess advantageous characteristics compared to plastic containers. However, securing covers to conventional paper-based containers is problematic due to the instability of the container material. According to the concepts and technologies described herein, the tray container 100 may be manufactured from relatively thin paper-based material, while allowing for film, mesh, or other types of material covers to be affixed to the container to secure the product within.

The tray container 100 described herein may be cut from a single sheet of paper-based material and folded from an unassembled configuration into an assembled configuration utilizing a unique folding and securing technique shown and described below with respect to FIGS. 15-26. Specifically, to allow for film and mesh covers to be secured to the tray container 100, the bonding surface 202 at a distal end of each side 102 is defined by a double layer of the container material that creates a reinforced surface substantially parallel to the bottom 106 of the container. The bonding surfaces 202 of each side join together to create a perimeter bonding surface to which a cover may be secured.

For the purposes of this disclosure, "bonding surface" and "perimeter bonding surface" may be used interchangeably as the perimeter bonding surface comprises each of the four bonding surfaces of the four corresponding container sides 102 secured together via corner tabs of the bonding surfaces, as discussed in greater detail below. The cover may be affixed to each bonding surface 202 with adhesive or any other suitable coupling method. As will become clear from the description below, the distal ends of the sides 102 have reinforced portions 204 that are two layers of material thickness, which along with the double layer of material defining the perimeter bonding surface, provide the structural rigidity and surface area sufficient for bonding a cover to the container.

In addition to the 2-layered perimeter bonding surface and reinforced portions 204, the tray container 100 additionally has foldable edge tabs 402 on vertically-oriented edges of two opposing container sides 102 that may be folded against and bonded to adjacent container sides 102 to secure the sides together and provide structural rigidity and support to the assembled container. This process will be described in greater detail below when discussing assembly of the tray container 100.

Figure 6:
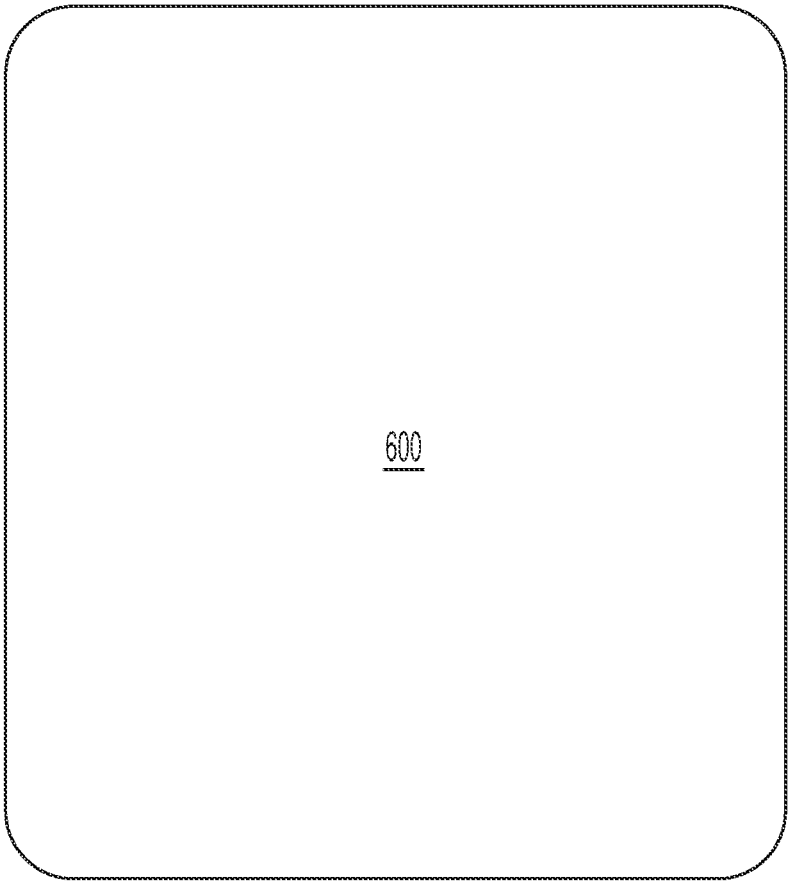
FIG. 6 is a top plan view of a tray container having a film cover, according to various embodiments described herein.
Figure 7:
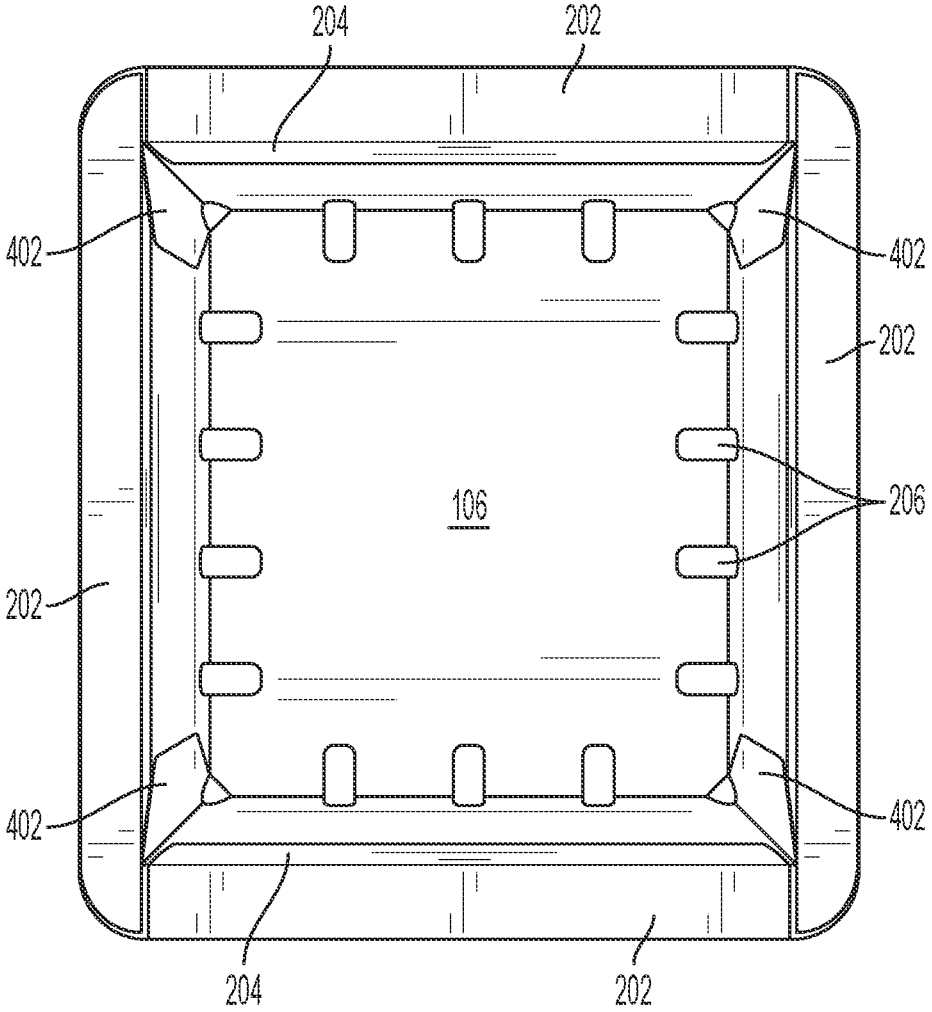
FIG. 7 is a bottom plan view of a tray container having a film cover, according to various embodiments described herein.
Figure 8:
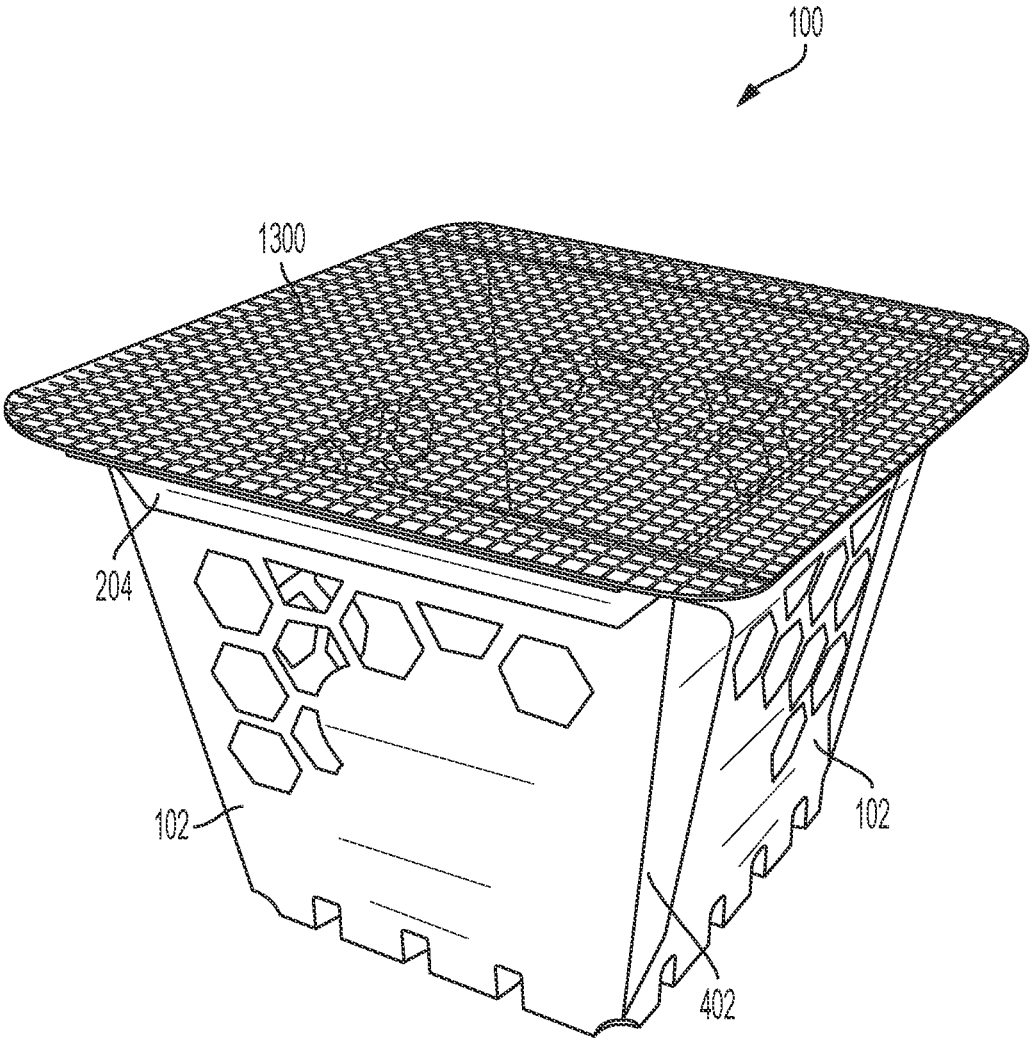
FIG. 8 is a front perspective view of a tray container having a mesh cover, according to various embodiments described herein.
Figure 9:
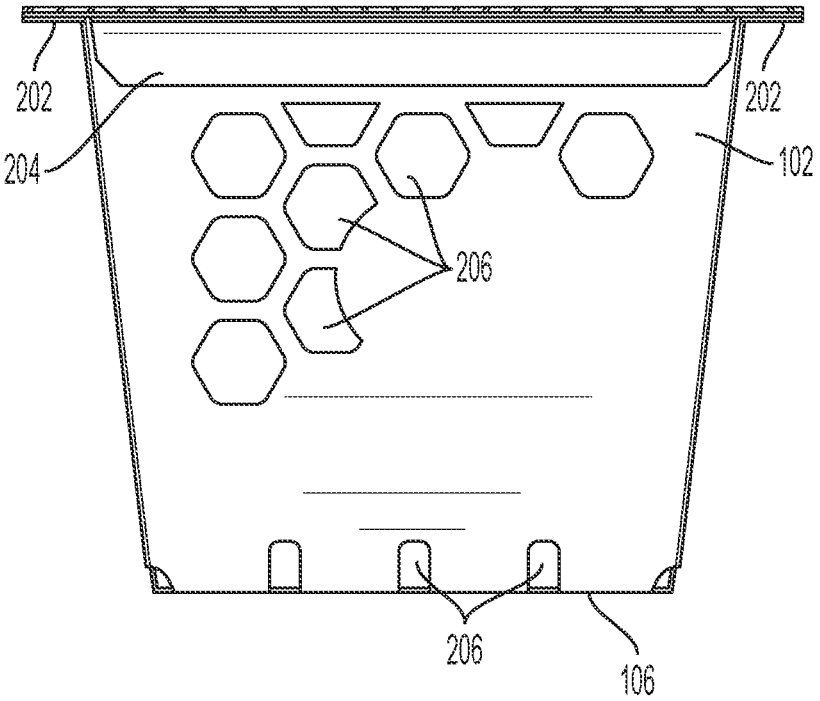
FIG. 9 is a front elevation view of a tray container having a mesh cover, according to various embodiments described herein.
Figure 10:
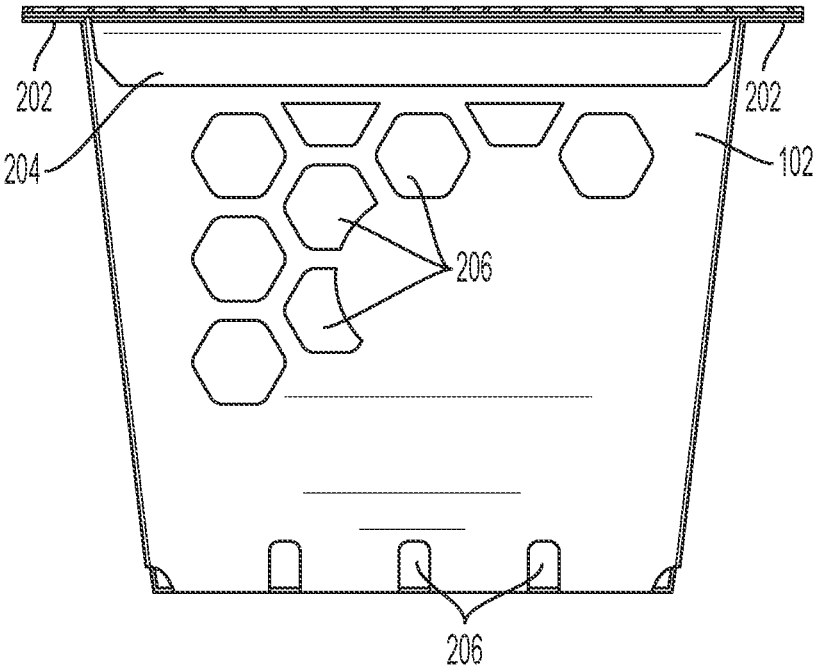
FIG. 10 is a rear elevation view of a tray container having a mesh cover, according to various embodiments described herein.
Figure 11:
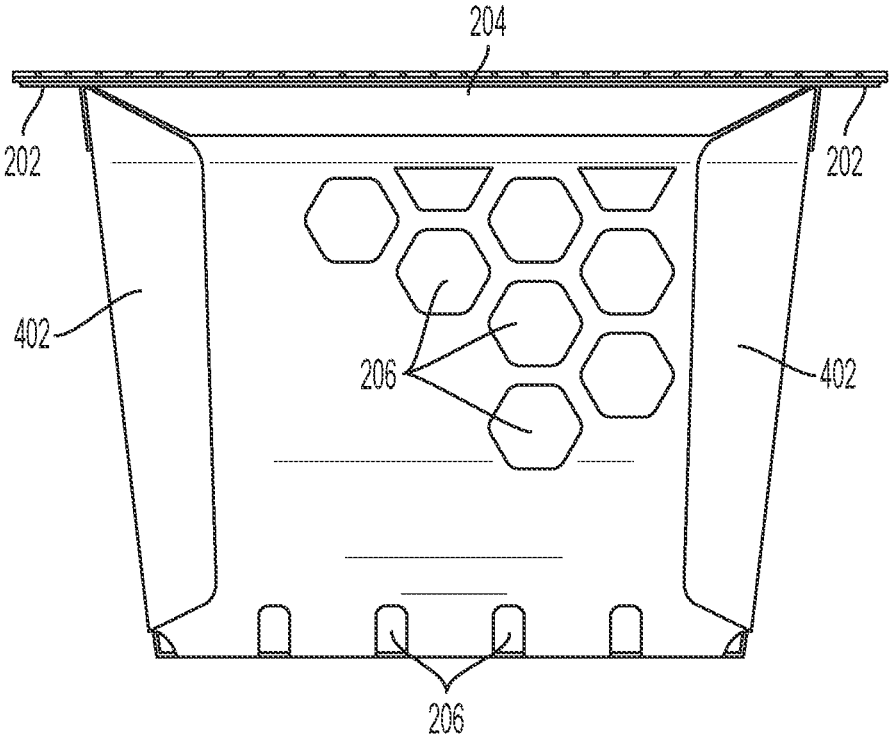
FIG. 11 is a left side elevation view of a tray container having a mesh cover, according to various embodiments described herein.
Figure 12:
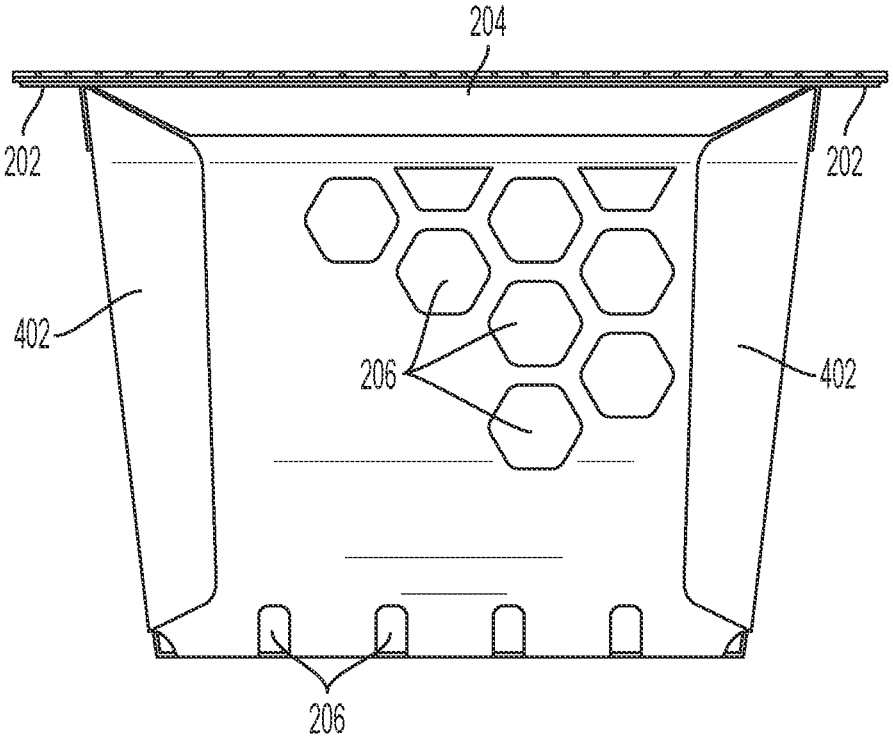
FIG. 12 is a right side elevation view of a tray container having a mesh cover, according to various embodiments described herein.
Figure 13:
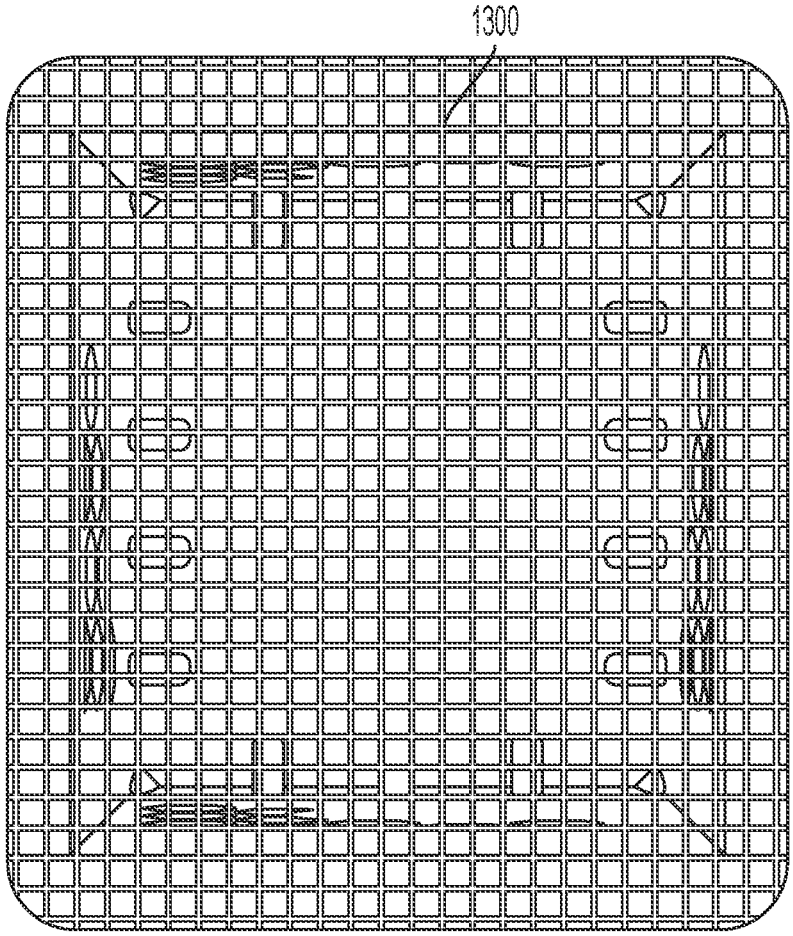
FIG. 13 is a top plan view of a tray container having a mesh cover, according to various embodiments described herein.
Figure 14:
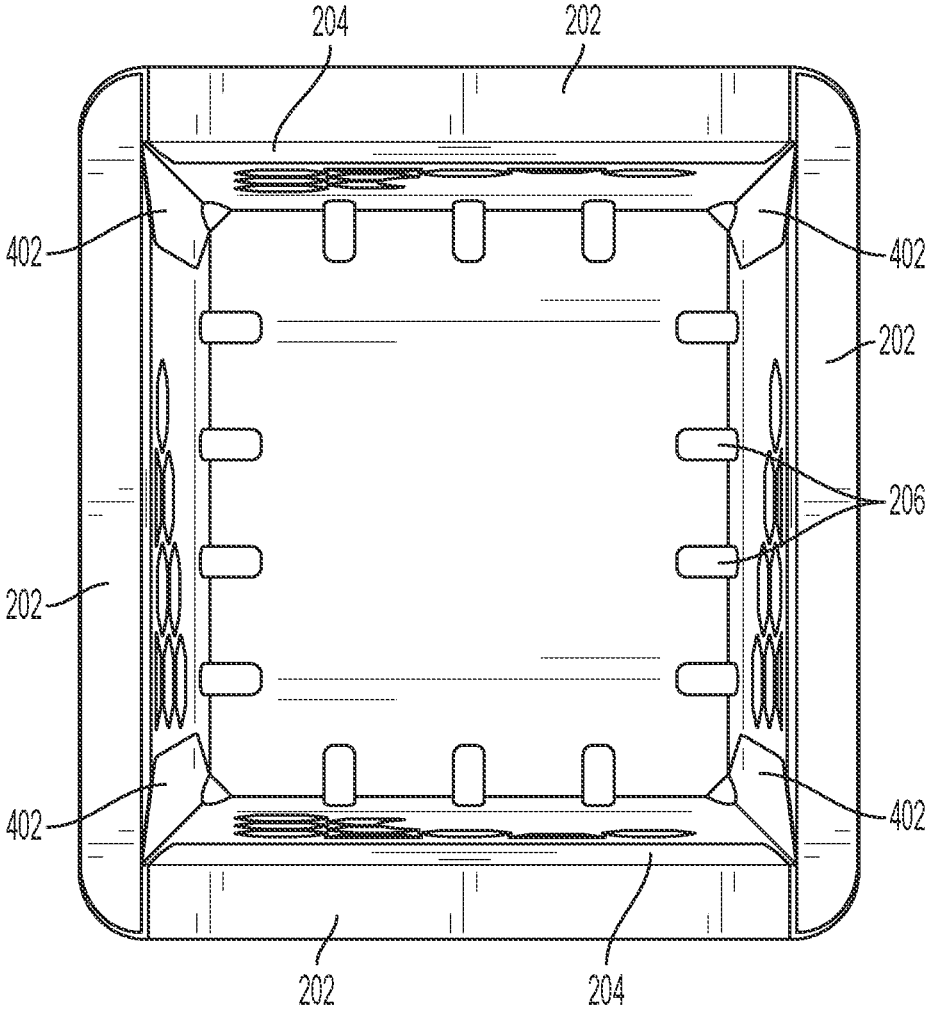
FIG. 14 is a bottom plan view of a tray container having a mesh cover, according to various embodiments described herein.

As seen most clearly in FIGS. 1 and 6, the cover according to one embodiment is a film cover 600. The film cover 600 includes a substantially non-porous material in that the material is substantially impervious to air and liquid. According to one embodiment, the film cover 600 is a polyethylene based film with or without a polyethylene terephthalate (PET) printed or unprinted lamination. The film cover 600 may be secured to the bonding surface 202 with thermo activated adhesive to prevent air and/or liquid from entering the tray container 100 from the top 104 and maintain freshness of the product within. According to an alternative embodiment shown in FIGS. 8-14, the cover of the tray container 100 is a mesh cover 1300. The mesh cover 1300 is best seen in FIGS. 8 and 13. The mesh cover 1300 includes a substantially porous material in that the material keeps the product inside the tray container 100 within the interior space defined within, while allowing for ambient air to flow in and out of the tray container 100. According to one embodiment, the mesh cover 1300 is a flat surface mesh made with polyethylene plastics that enable thermo activated adhesion.

Figure 15:
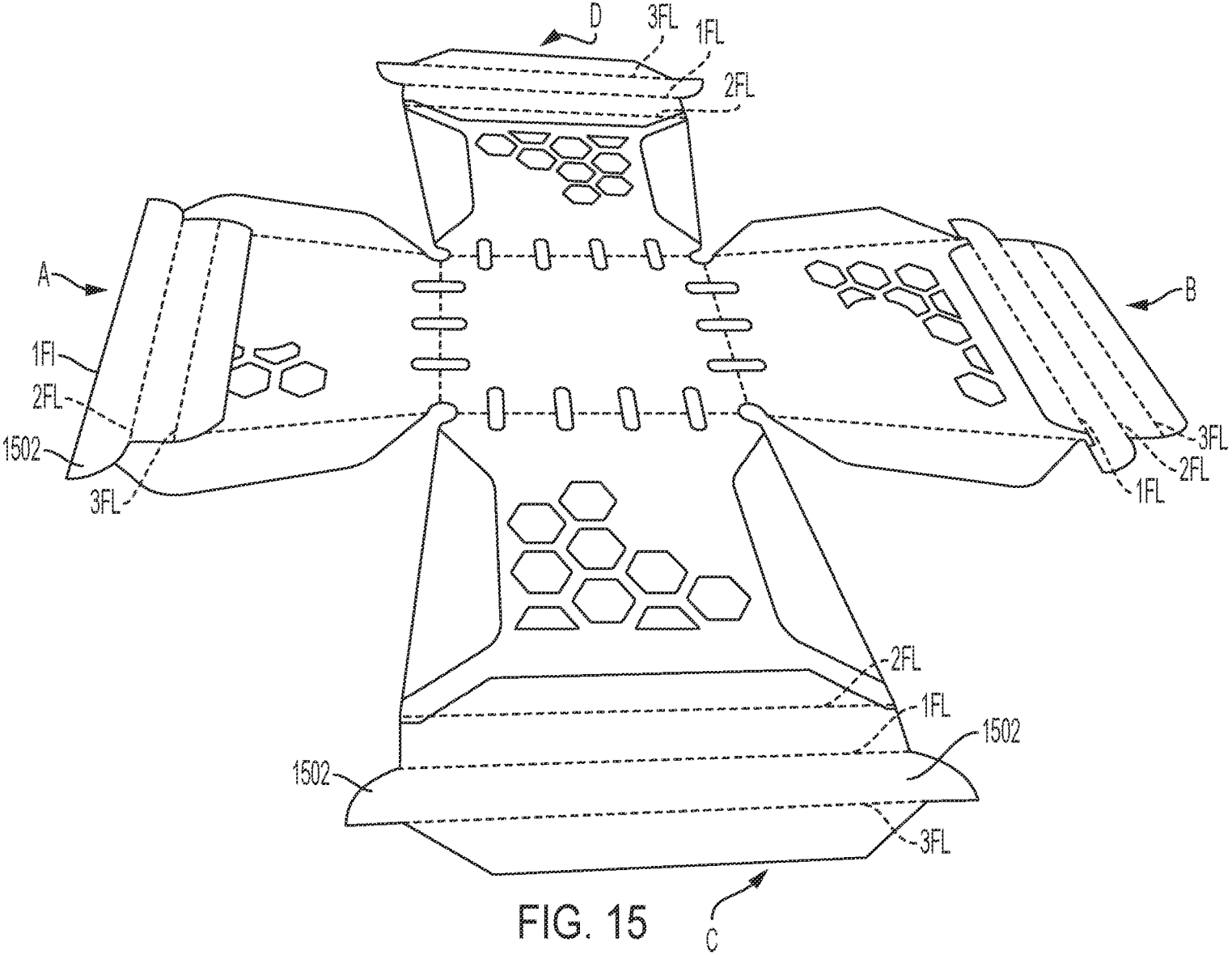
FIGS. 15-26 are perspective views of a tray container in various stages of assembly, according to various embodiments described herein.

Turning now to FIGS. 15-26, the transition of a tray container 100 between an unassembled configuration to an assembled configuration will be shown and described. FIG. 15 shows a tray container 100 in substantially an unassembled configuration in which the sides 102 lay flat against a surface coplanar with the container bottom 106. FIGS. 15-26 show a progression from unassembled to assembled configurations, illustrating the folding process of distal ends of the container sides 102 to create the multi-layered bonding surface 202 and reinforced portions 204 that provide structural support for securing the film cover 600 or mesh cover 1300 to the container to complete the top 104.

FIG. 15 shows four container sides 102, labeled A-D for illustrative purposes. In this example, two different folding configurations are shown. The first is illustrated on side A and opposite side B, and will be primarily shown being folded into the assembled configuration via FIGS. 15-26. The second folding configuration is illustrated with side C and opposite side D and will be described below as an alternative. Either folding configuration and corresponding folding process may be used, or a combination of both folding configurations and processes, without departing from the scope of this disclosure.

As seen in FIG. 15, the unassembled tray container 100 may be cut from a single sheet of paper-based material, with an optional food-grade wax applied to one or both surfaces of the container (interior and exterior). In this view, the external surface of the container is seen with the interior surface being positioned face-down. Any desired apertures 206 may be cut from the material in the desired locations and configurations according to the desired positioning in the resulting assembled container. Perforations, indentions, prebent portions, or any other known methods of creating folding lines (labeled "FL") may be created in the unassembled tray container 100 to facilitate and guide the various folds described below.

Side B shows the complete unassembled (unfolded) first folding configuration, which includes three fold lines labeled "1FL," "2FL," and "3FL," respectively. Side A shows a container side 102 that is identical to side B, with the distal end folded inward along 1FL such that the outer portion of the distal end of side A overlaps a portion of the side to create a double layer of material. The bonding surfaces 202 each include a pair of corner tabs 1502, each corner tab 1502 being positioned on opposite sides of the corresponding bonding surface 202 for overlapping and bonding to a corner tab 1502 of an adjacent bonding surface 202 to create a contiguous perimeter bonding surface to which the cover is affixed.

Figure 16:
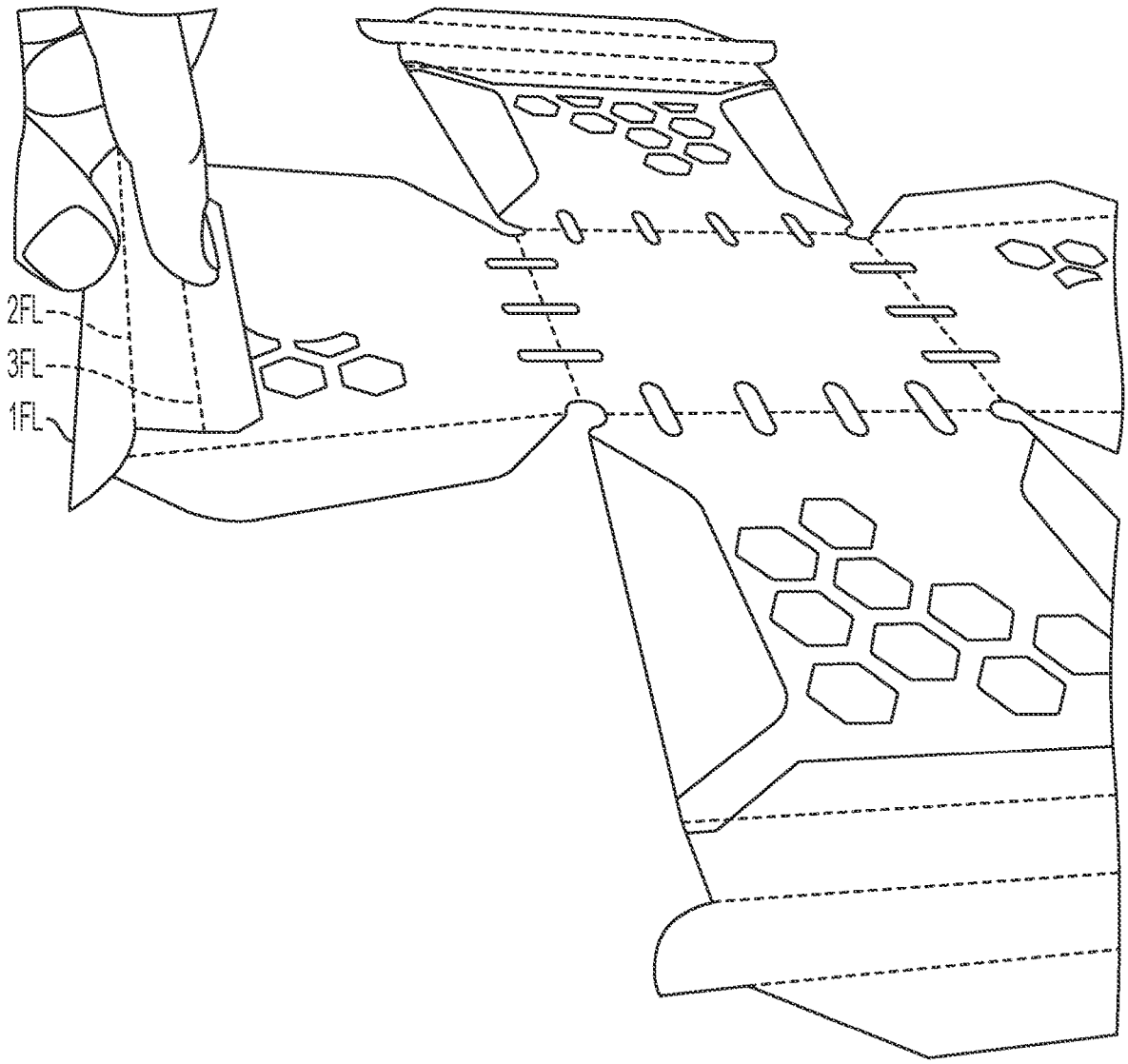
Figure 17:
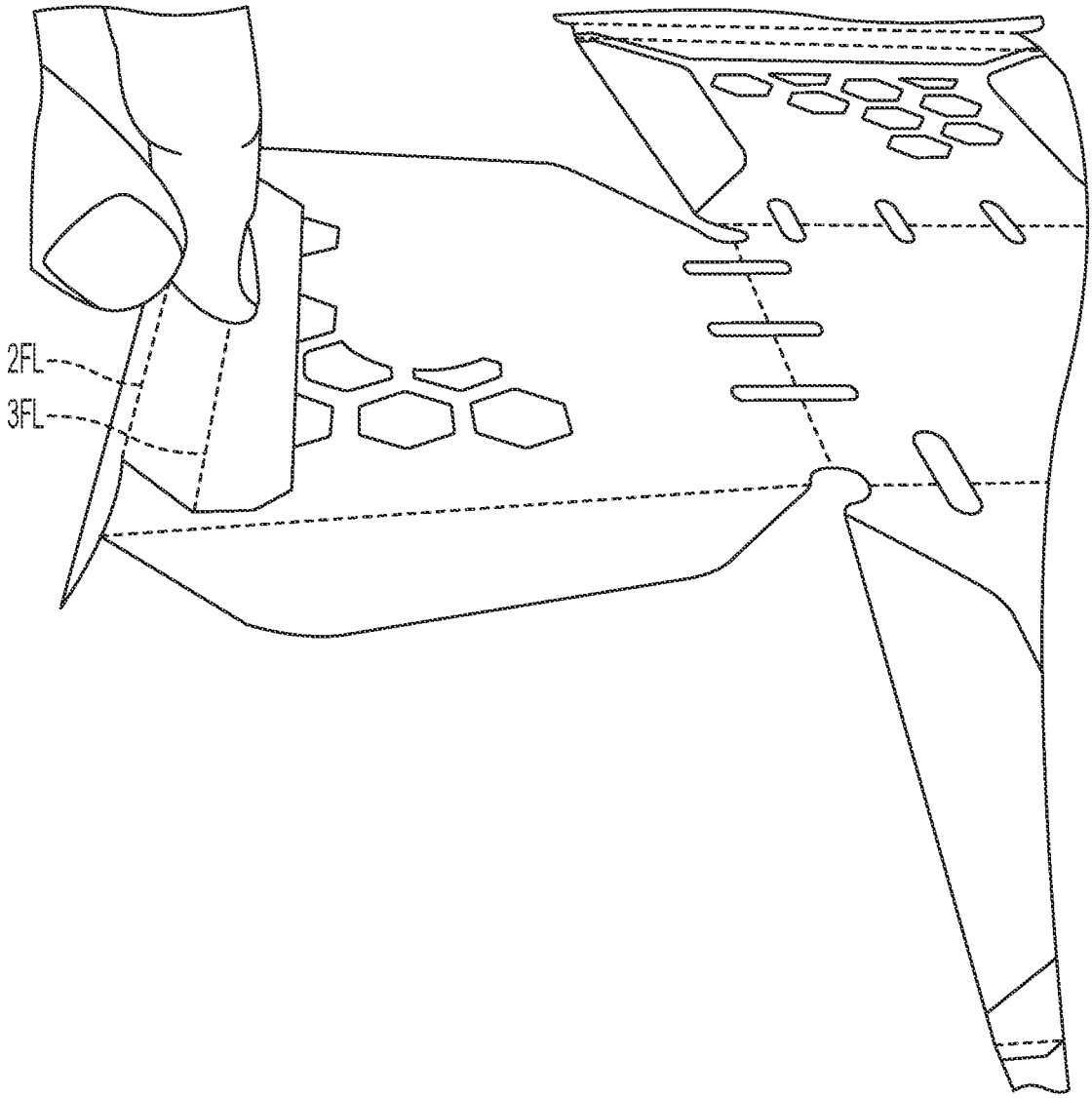
Figure 18:
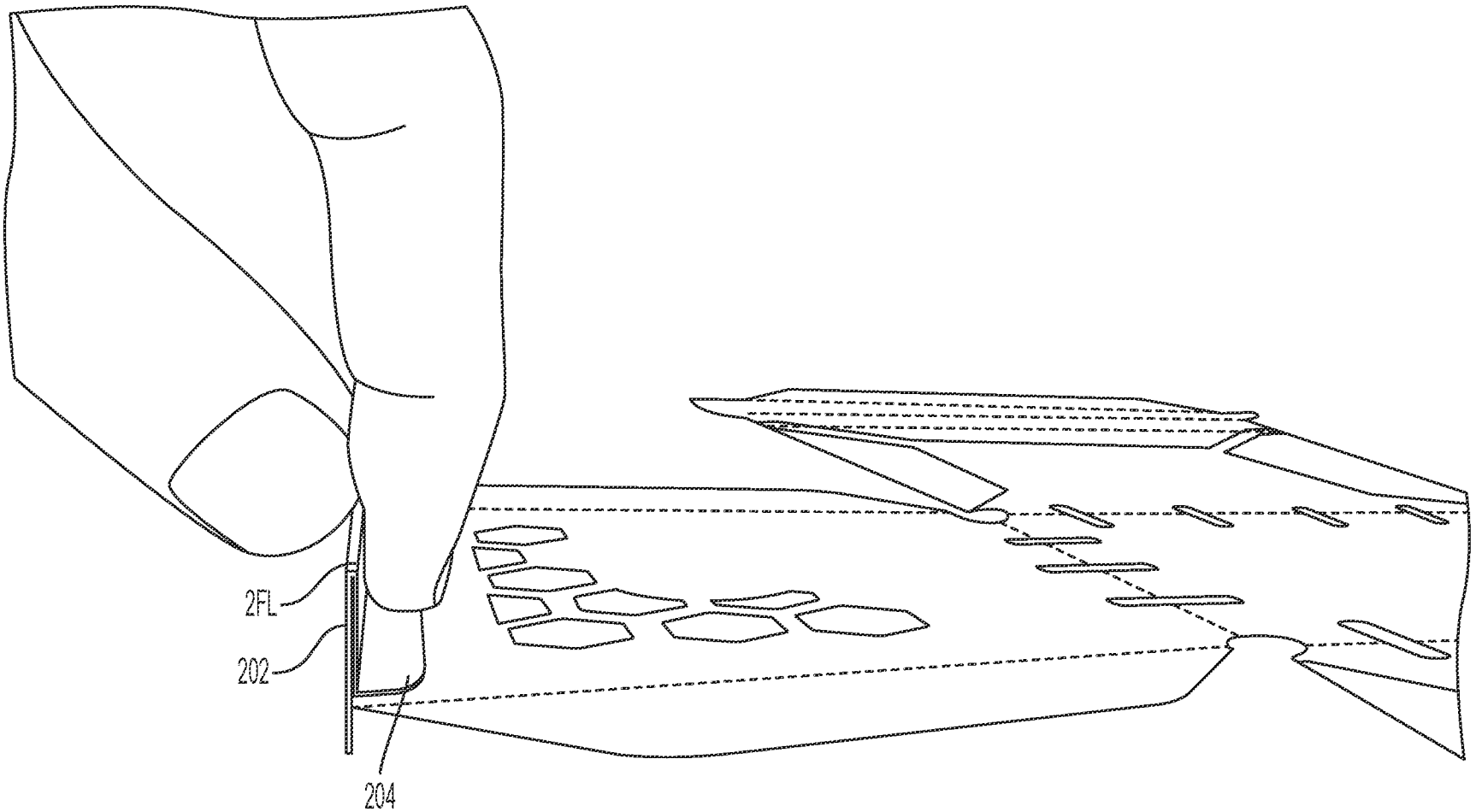

FIG. 16 shows the distal end of side A being folded along 2FL and 3FL simultaneously. To do so, the panel defined between 3FL and the outer edge of the distal end of side A (closest to the center of the container) is slid toward 1FL, bending along fold lines 2FL and 3FL so that the panel defined between 2FL and 3FL abuts the panel defined between 1FL and 2FL. FIGS. 16-19 show this progression to create the bonding surface 202 and reinforced portion 204. It should be appreciated that although the various figures depict the folding process as being done by hand for illustrative and clarity purposes, the folding process is automated according to various embodiments. Automation provides numerous advantages over performing the process by hand, specifically allowing for speed and precision that is not capable by a human performing the same function.

Returning to FIG. 15, the second folding configuration that may be used to create a bonding surface 202 on a distal end of a container side 102 will be described. Looking at side C, the distal end may first be folding outward approximately 180 degrees along 1FL until the panels defined between 1FL and 3FL and between 3FL and the outer edge overlap the panels defined between 1FL and 2FL and between 2FL and the lower edge, respectively. An outward fold of the double layered material along abutting coaxial folding lines 2FL and 3FL approximately 45-90 degrees creates the bonding surface 202. The precise angle of the outward fold depends on the desired angle of the container sides 102 respective to the container bottom 106. The bonding surface 202 should be substantially coplanar with the container bottom 106 when assembled, which controls the precise angle of the outward fold. According to one embodiment, the outward fold is between 45-85 degrees. It should be appreciated that any suitable food-grade adhesive may be utilized to bond any abutting surfaces together after folding to secure the double layers of material in place.

It should be noted that with the first folding configuration described with respect to sides A and B, the pair of corner tabs 1502 are initially positioned below or distally inward from the 1FL fold line around which the 180 degree fold is made. Conversely, the other sides (C and D) utilizing the second folding configuration include corner tabs 1502 that are initially positioned above or distally outward from the 1FL fold line around which the 180 degree fold is made. In doing so, when the bonding surfaces 202 are coupled together via adjacent corner tabs 1502, a first corner tab 1502 will extend from a top layer of the two-layered bonding surface and the complimentary second corner tab 1502 will extend from a bottom layer of the two-layered bonding surface such that when bonded, a contiguous two-layered perimeter bonding surface will be created.

Figure 19:
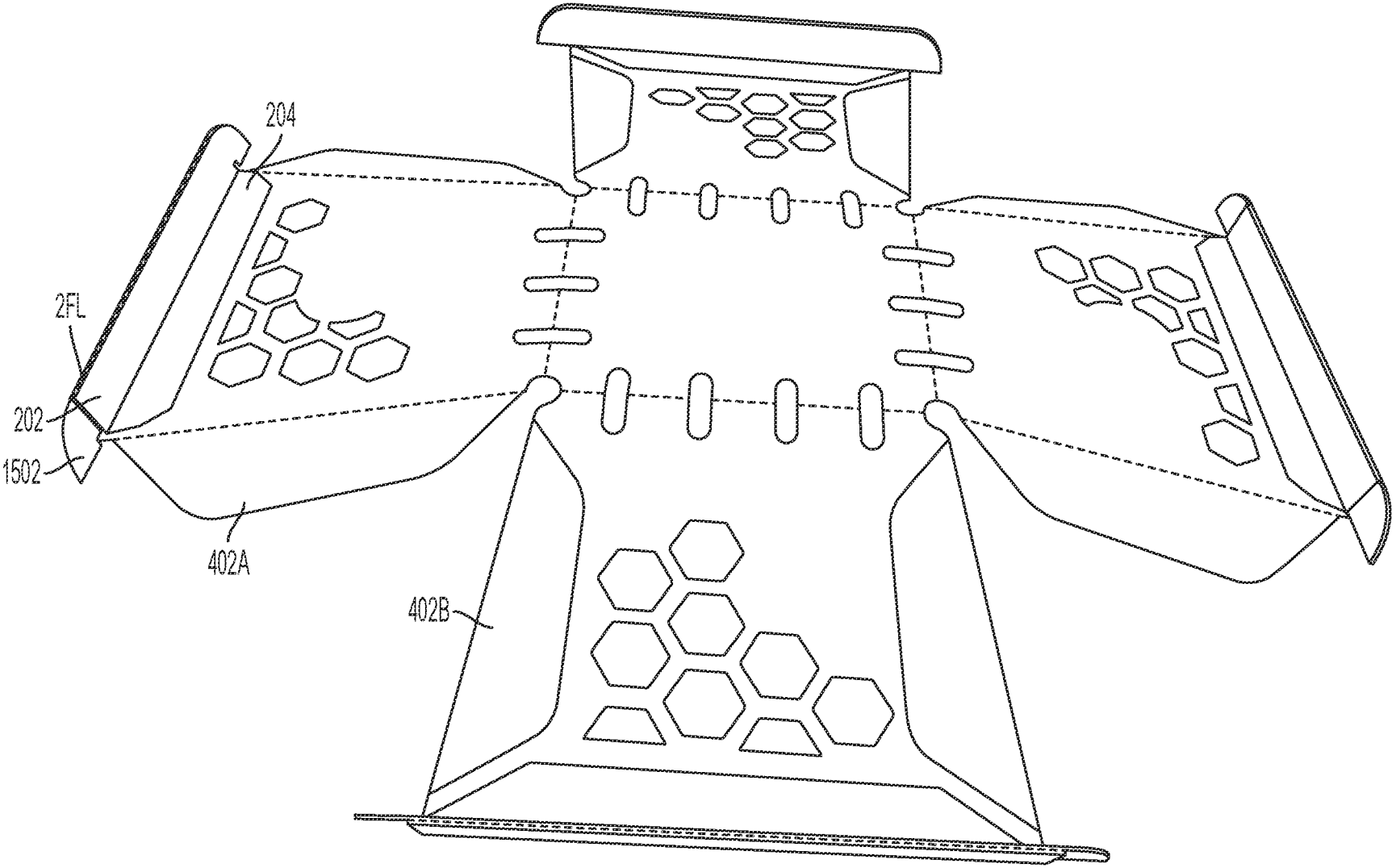
Figure 20:
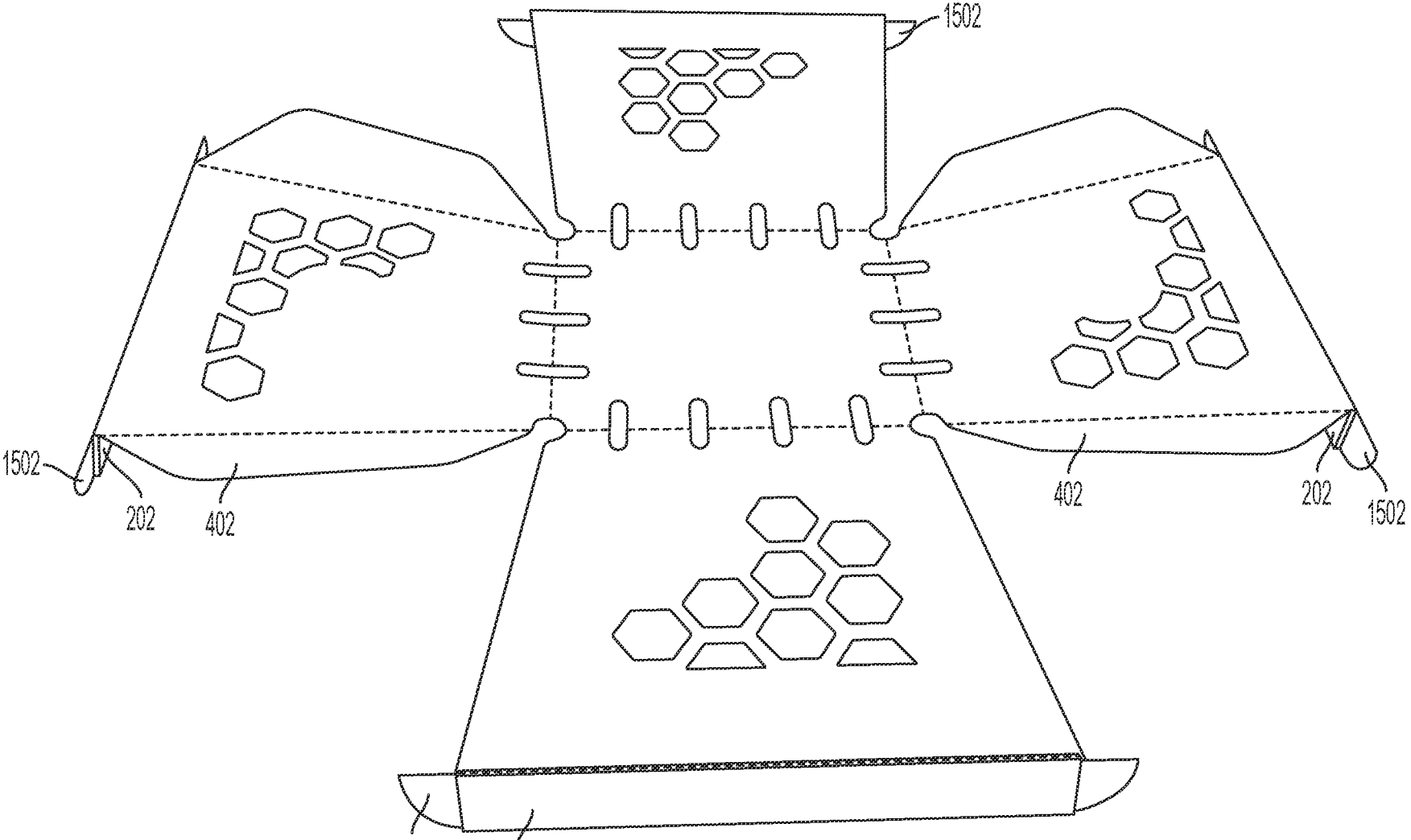

FIG. 20 shows the tray container 100 of FIG. 19 flipped over such that the interior surface is now facing upwards. From this configuration, the sides will be folded upward to the final position in which they will be bonded together, and the bonding surfaces will be bonded together via corner tabs 1502, to create the assembled configuration of the tray container 100. In the assembled configuration, the tray container 100 has a perimeter bonding surface defining a bonding surface plane that is approximately parallel to a bottom plane defined by the container bottom 106 to receive a film or mesh cover.

Figure 21:
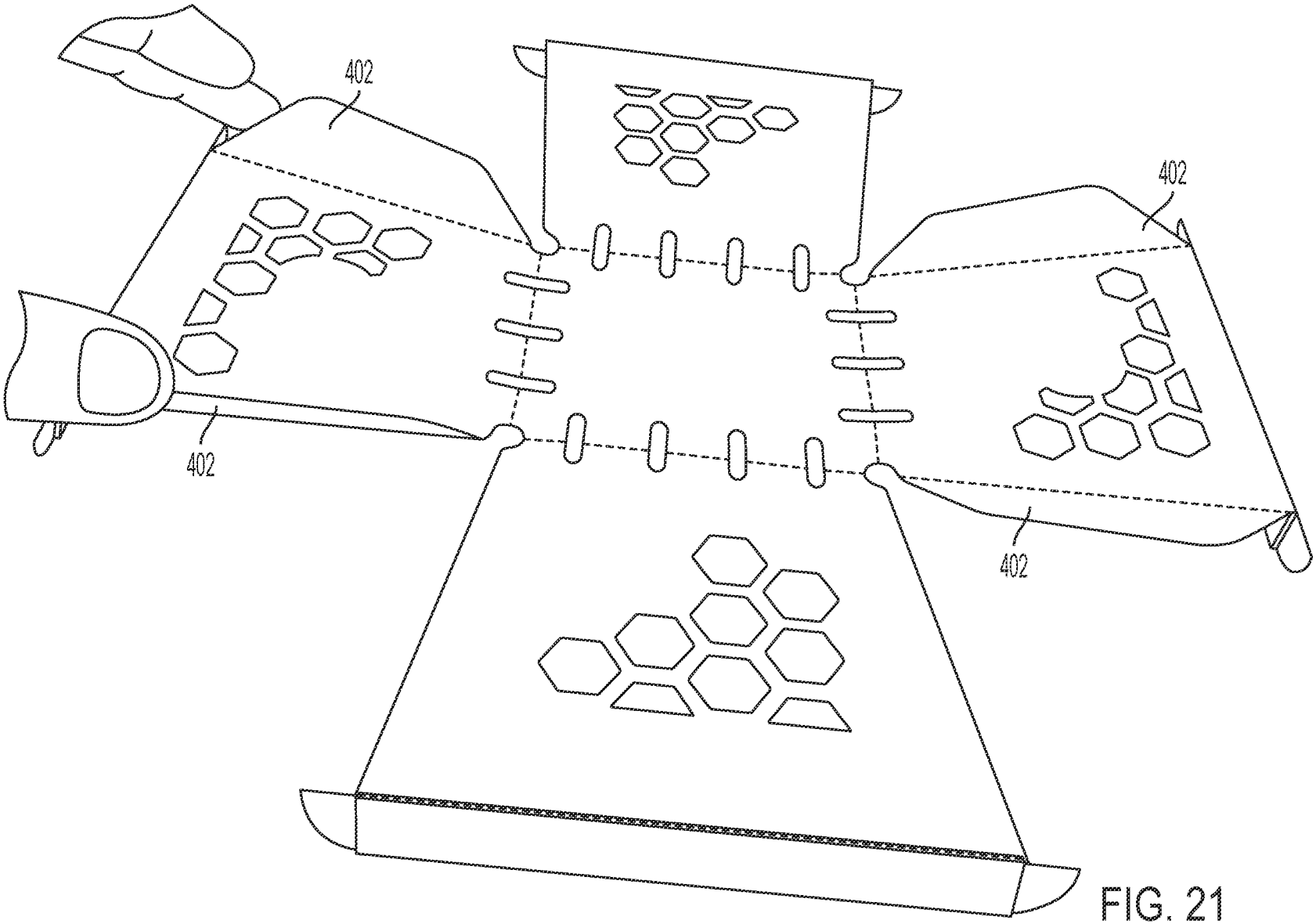
Figure 22:
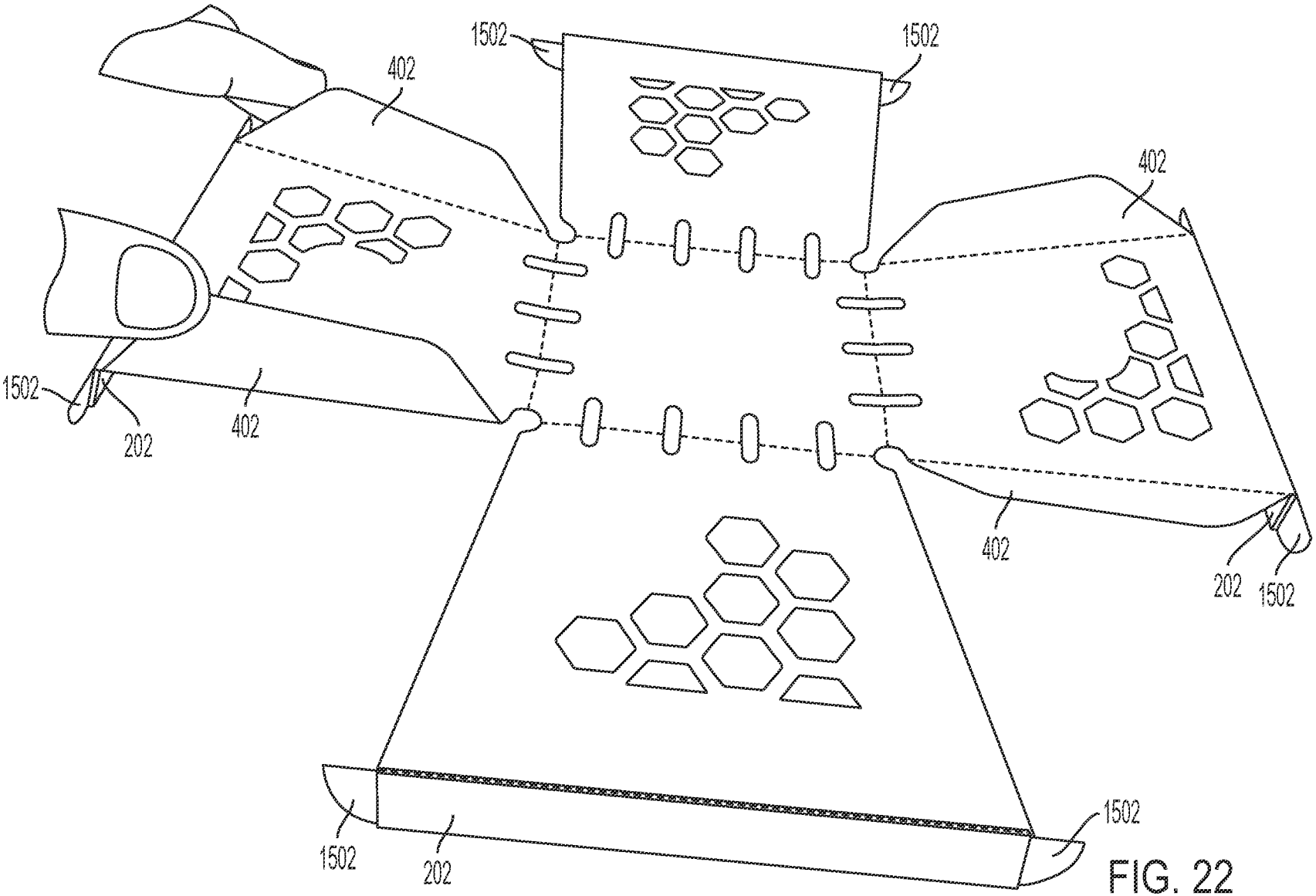
Figure 23:
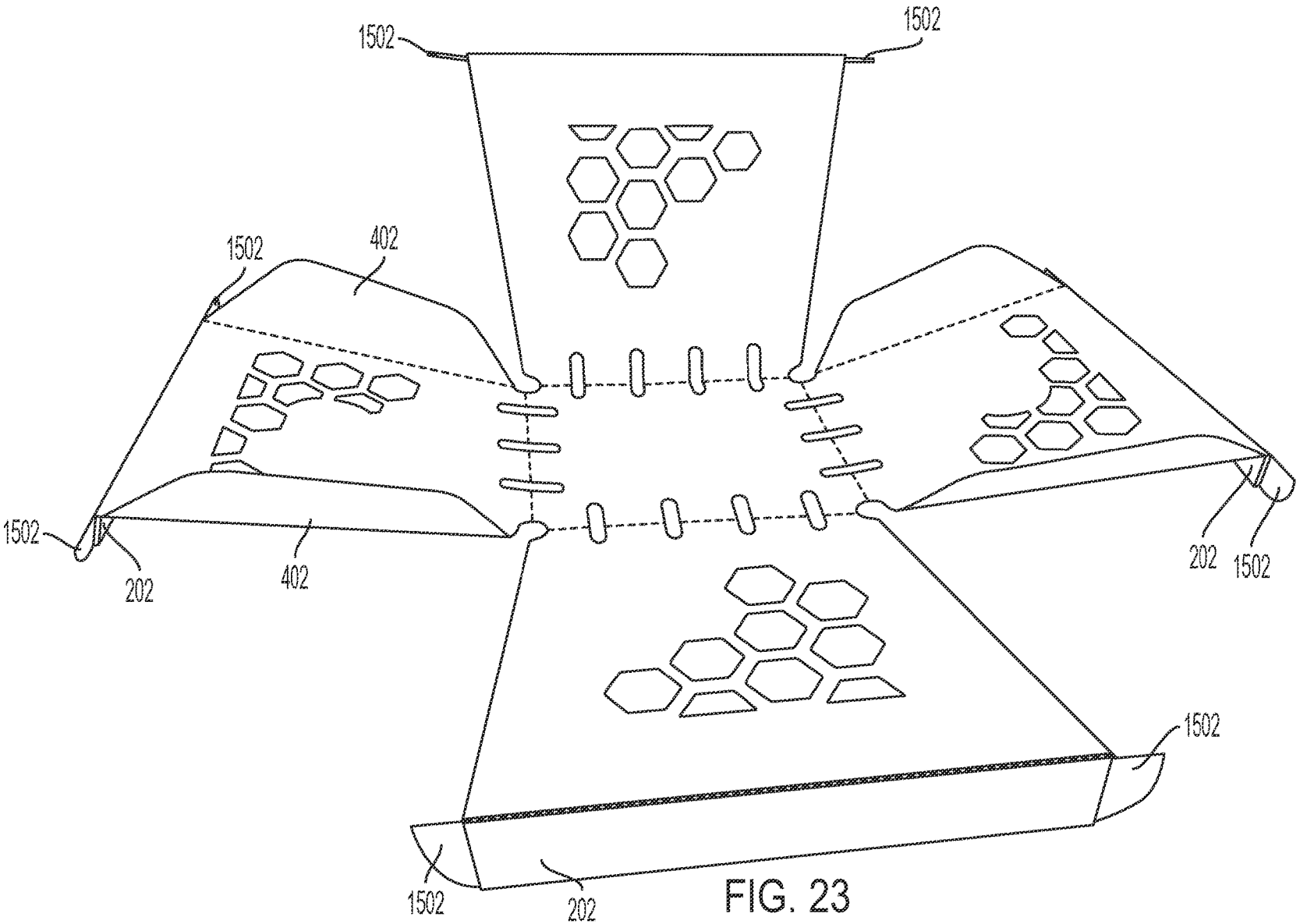
Figure 24:
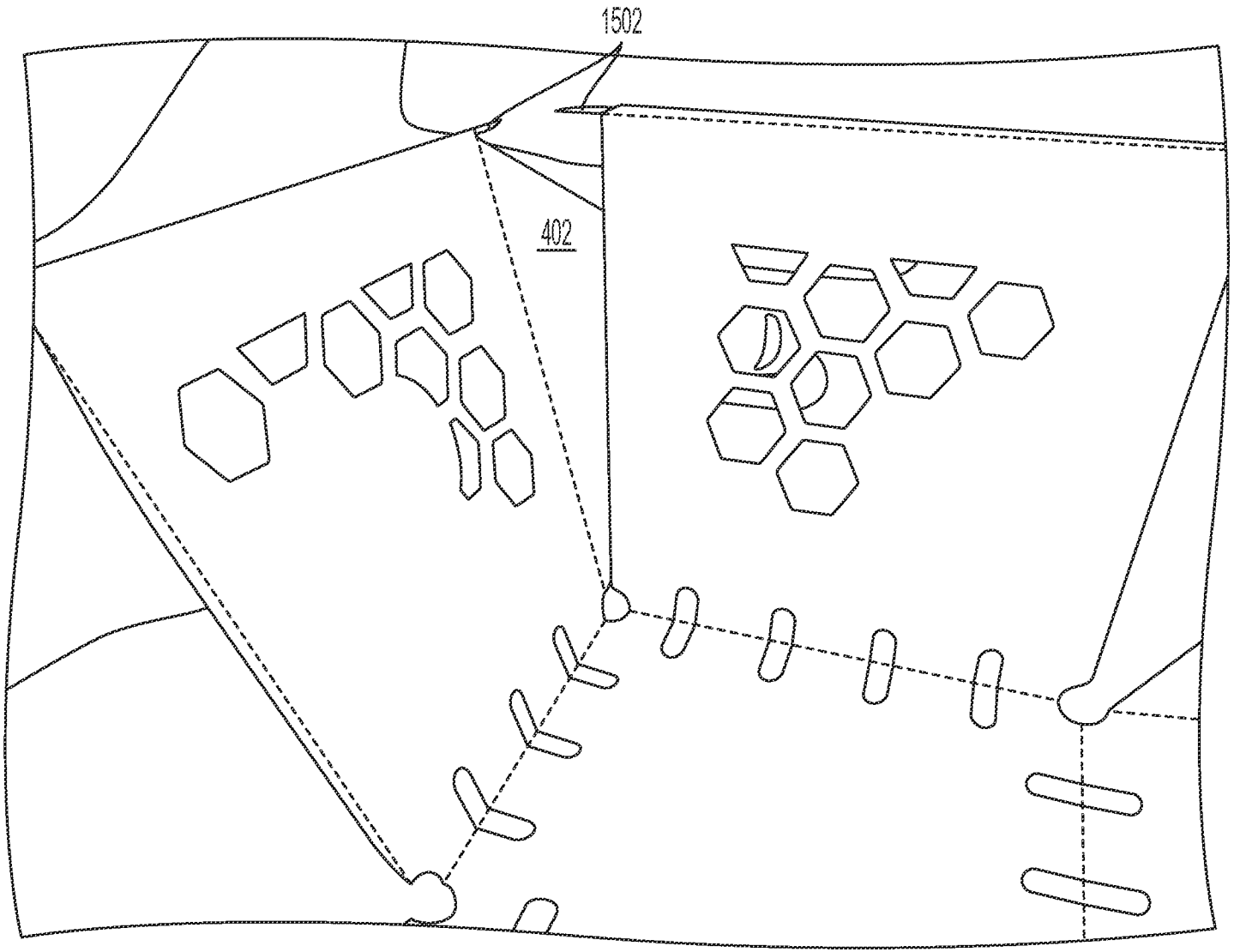
Figure 25:
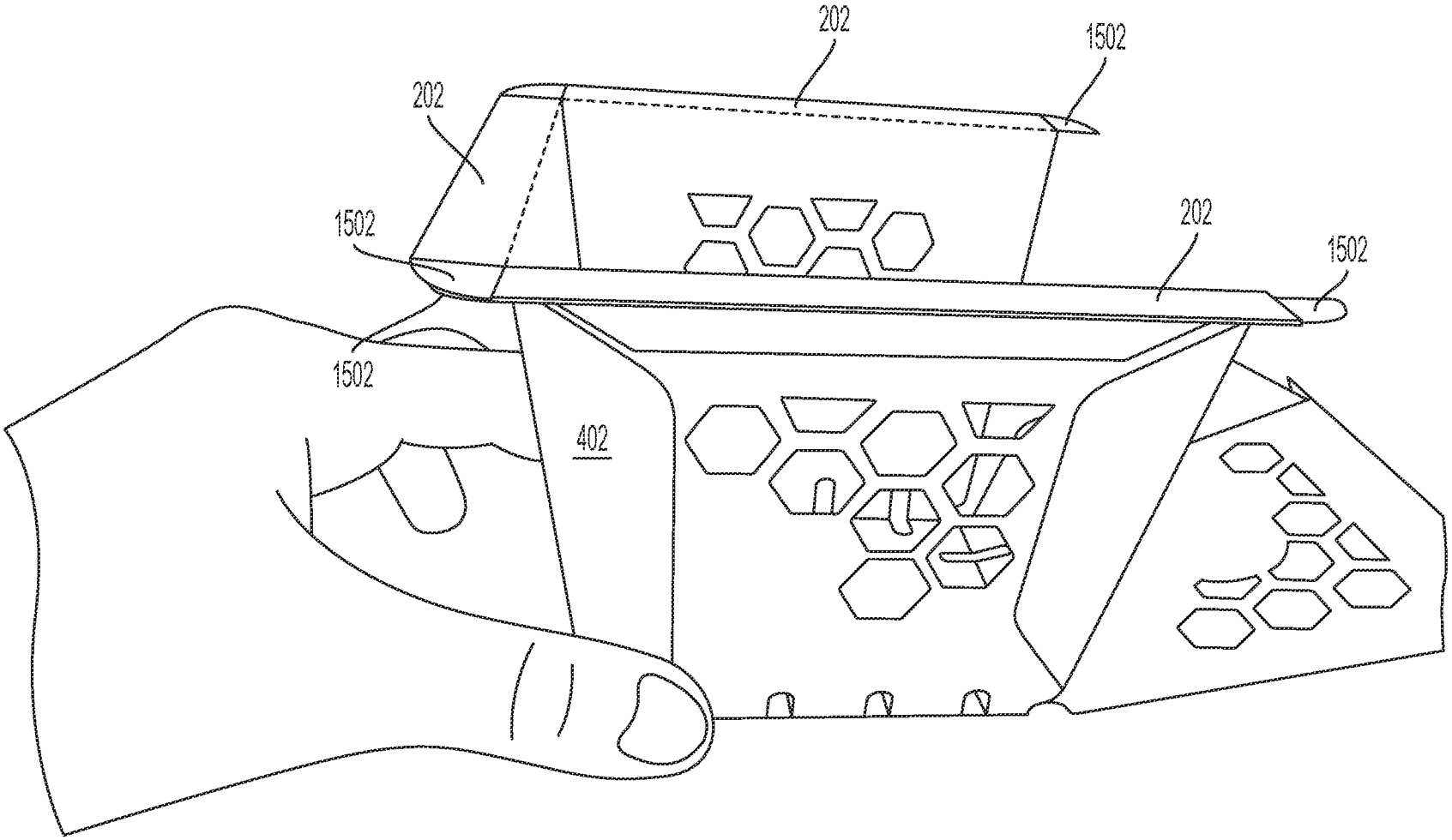
Figure 26:
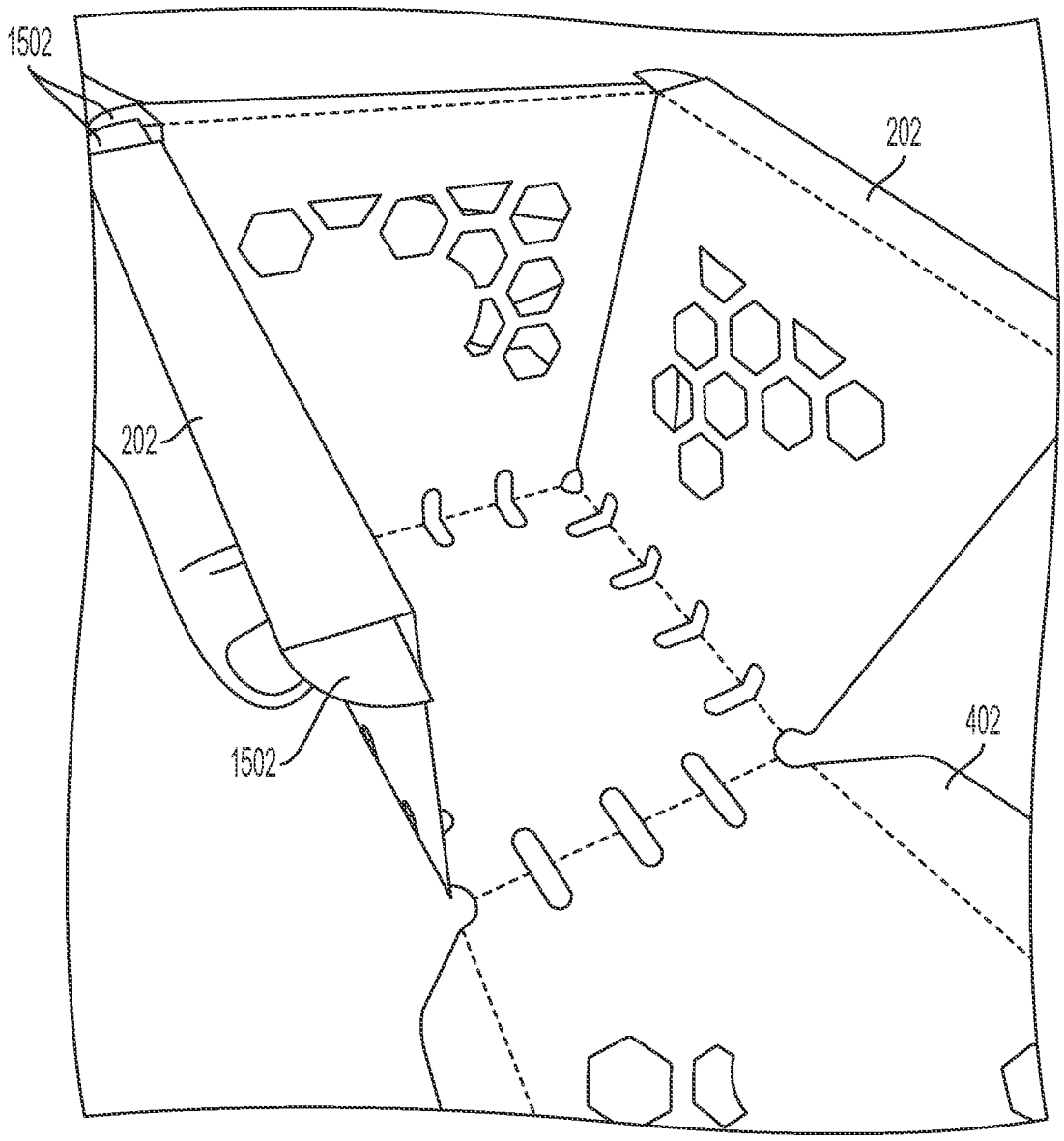

As seen in FIG. 21, two of the sides 102 (sides A and B in this example) include foldable edge tabs 402 that are folded inward for coupling to an adjacent side via a food-grade adhesive. Alternatively, each side 102 may include one foldable edge tab 402 along a vertically oriented edge for coupling to a vertically oriented edge of an adjacent side 102. FIGS. 22-25 show the foldable edge tabs 402 being folded inward while the sides are folded upward away from the container bottom 106 into a final assembled position. FIGS. 25 and 26 illustrate the overlapping of the foldable edge tabs 402 with an adjacent side, and the overlapping of the corner tabs 1502 to create the perimeter bonding surface to which the cover is attached.

Figure 27:
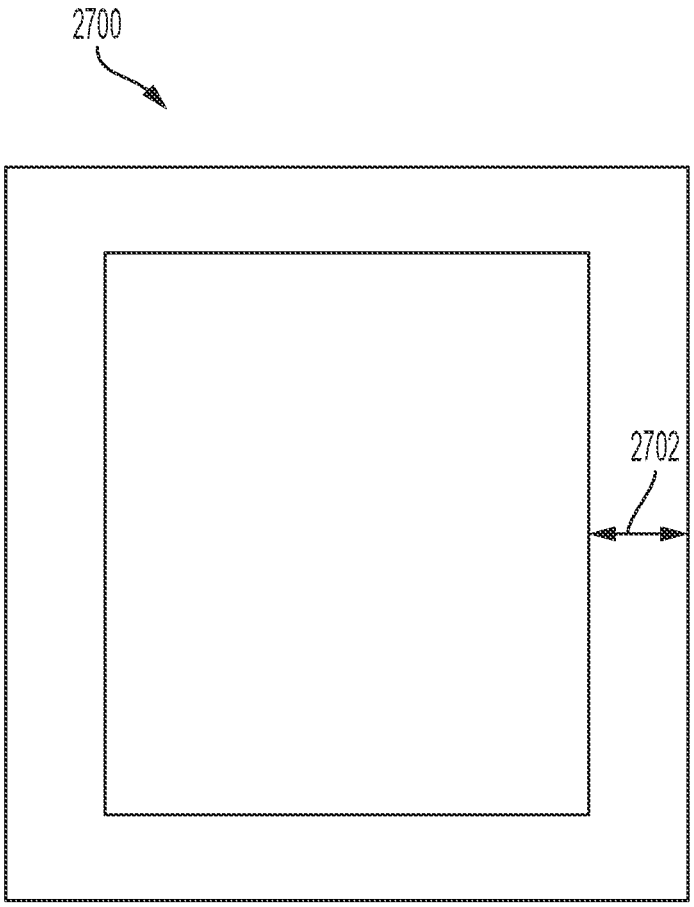
FIG. 27 is a top view of a support ring, according to various embodiments described herein.

FIG. 27 shows a top view of a support ring 2700 according to various embodiments. The support ring 2700 may be used to provide additional structural support to the perimeter bonding surface to aid in securing a cover to the tray container 100. The support ring 2700 assists in maintaining the cover in place as well as maintaining the shape and structure of the tray container when the cover is secured in place. The portions of the tray container 100 described above (i.e., bottom and sides) include a first contiguous material and the support ring includes a second contiguous material such that the support ring is a separate component from the tray container until bonded with a rim of the assembled container.

The support ring material and/or thickness, particularly when coupled with the perimeter bonding surface of the container, increases the rigidity of the top perimeter of the container. The support ring 2700 is sized and shaped according to the size and shape of the top portion of the tray container 100 to which it is to be attached. Specifically, according to the embodiments shown herein, the support ring 2700 is generally rectangular in shape, having an inner and an outer perimeter defining a support ring width 2702 therebetween. The support ring width 2702 is substantially equal to or greater than a width of the perimeter bonding surface 2802 of the rim 2800 (both shown in FIG. 28) of the tray container that is created by the various bonding surfaces 202 of the container sides, which are folded into the assembled configuration as described above. In doing so, increased rigidity of the container rim and increased bonding surface area for securing the cover to the container is ensured.

Figure 28:
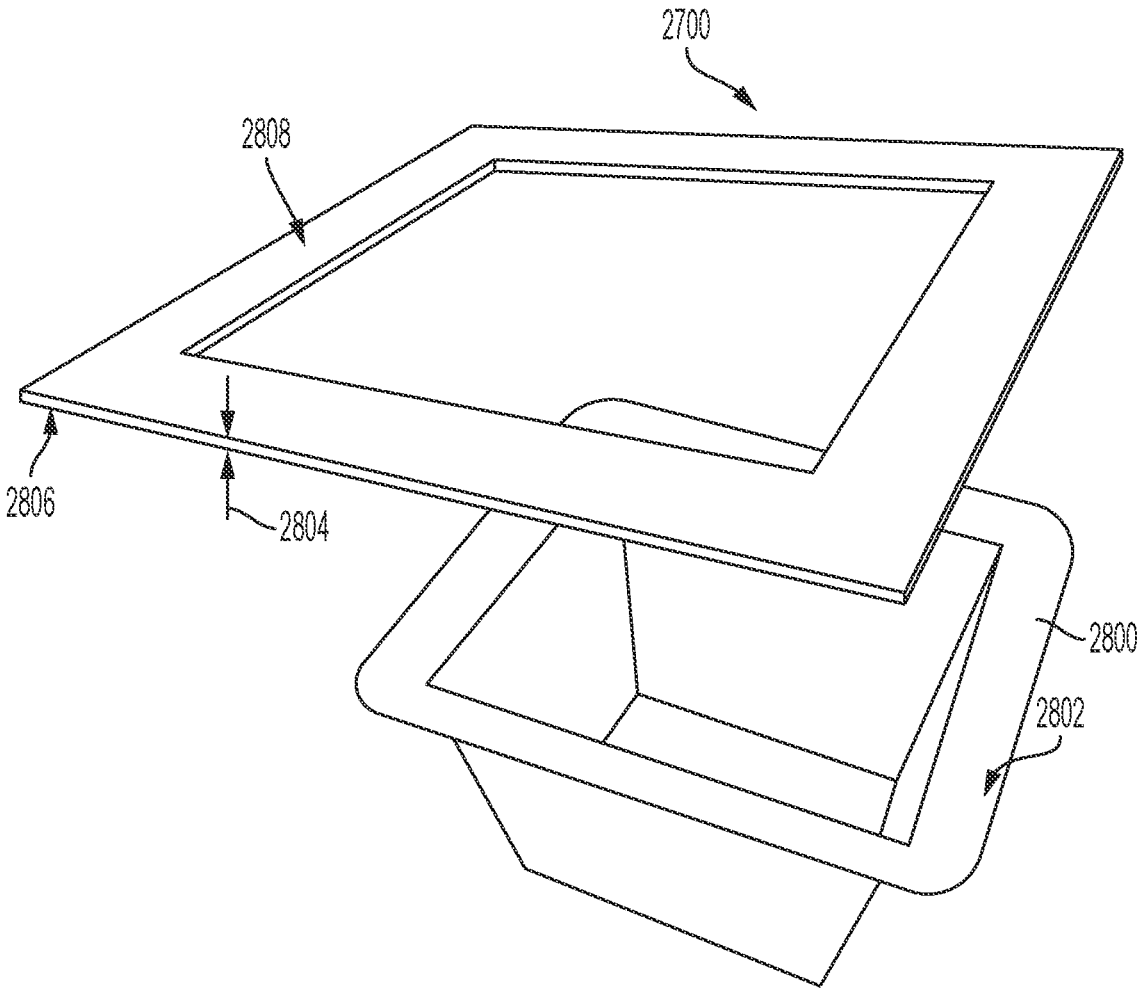
FIG. 28 is an exploded view of a support ring and a tray container, according to various embodiments described herein.
Figure 29:
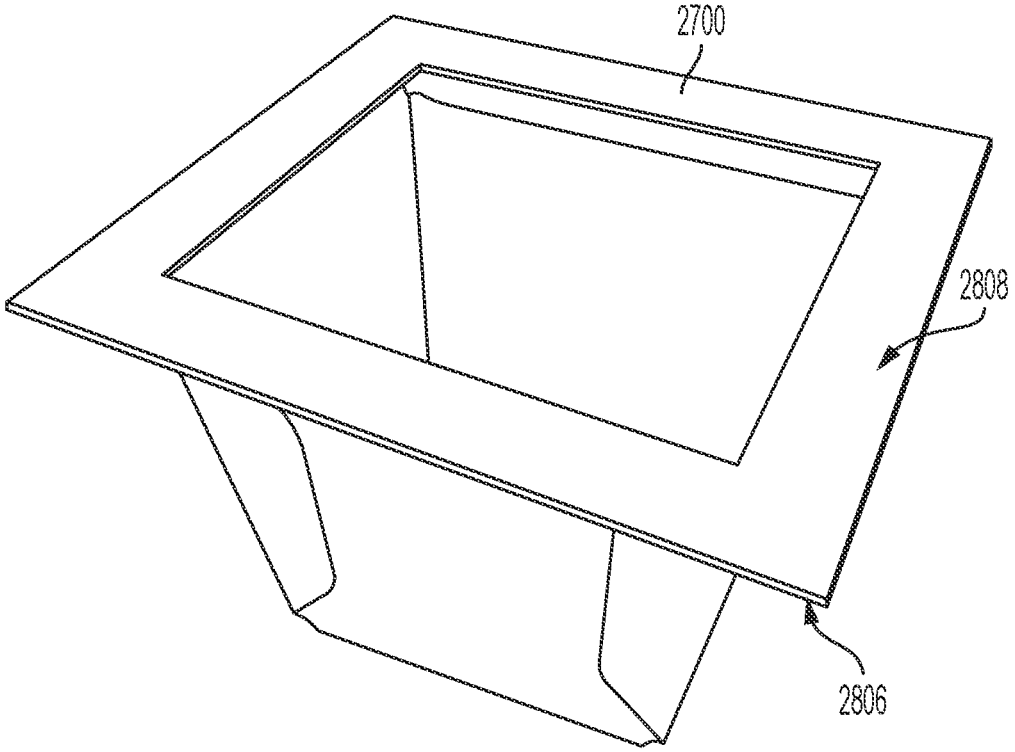
FIG. 29 is a perspective view of a tray container with a support ring secured thereon, according to various embodiments described herein.

FIG. 28 shows the support ring 2700 above the rim 2800 and corresponding perimeter bonding surface 2802 of the tray container 100 before coupling the support ring 2700 to the container, while FIG. 29 shows the support ring 2700 bonded to the rim 2800 and prepared to receive a cover. The thickness 2804 of the support ring 2700 may be selected according to the desired rigidity of the support ring and coupled rim 2800. Specifically, the thickness 2804 may be selected to provide a minimal rigidity that supports the desired cover while minimizing material quantities and associated cost and weight. As one non-limiting example, a food-grade cardboard or paper-based material may be used to create the support ring 2700.

A bottom surface 2806 of the support ring 2700 may include a treatment that facilitates bonding with the perimeter bonding surface 2802 of the rim 2800. For example, the bottom surface 2806 may be coated in an adhesive. The adhesive may be applied just before bonding the support ring 2700 to the rim 2800. Alternatively, the bottom surface 2806 of the support ring 2700 may be pre-coated with an adhesive during manufacturing such that later assembly simply includes utilizing pressure to bond the support ring 2700 to the rim 2800 of the tray container. Similarly, a treatment may be applied to a cover bonding surface 2808 of the support ring 2700 that facilitates bonding with a cover. For example, according to one embodiment, the cover bonding surface 2808 of the support ring 2700 may include a plastic or polymer coating that facilitates the bonding process of a cover to the tray container.

Figure 30:
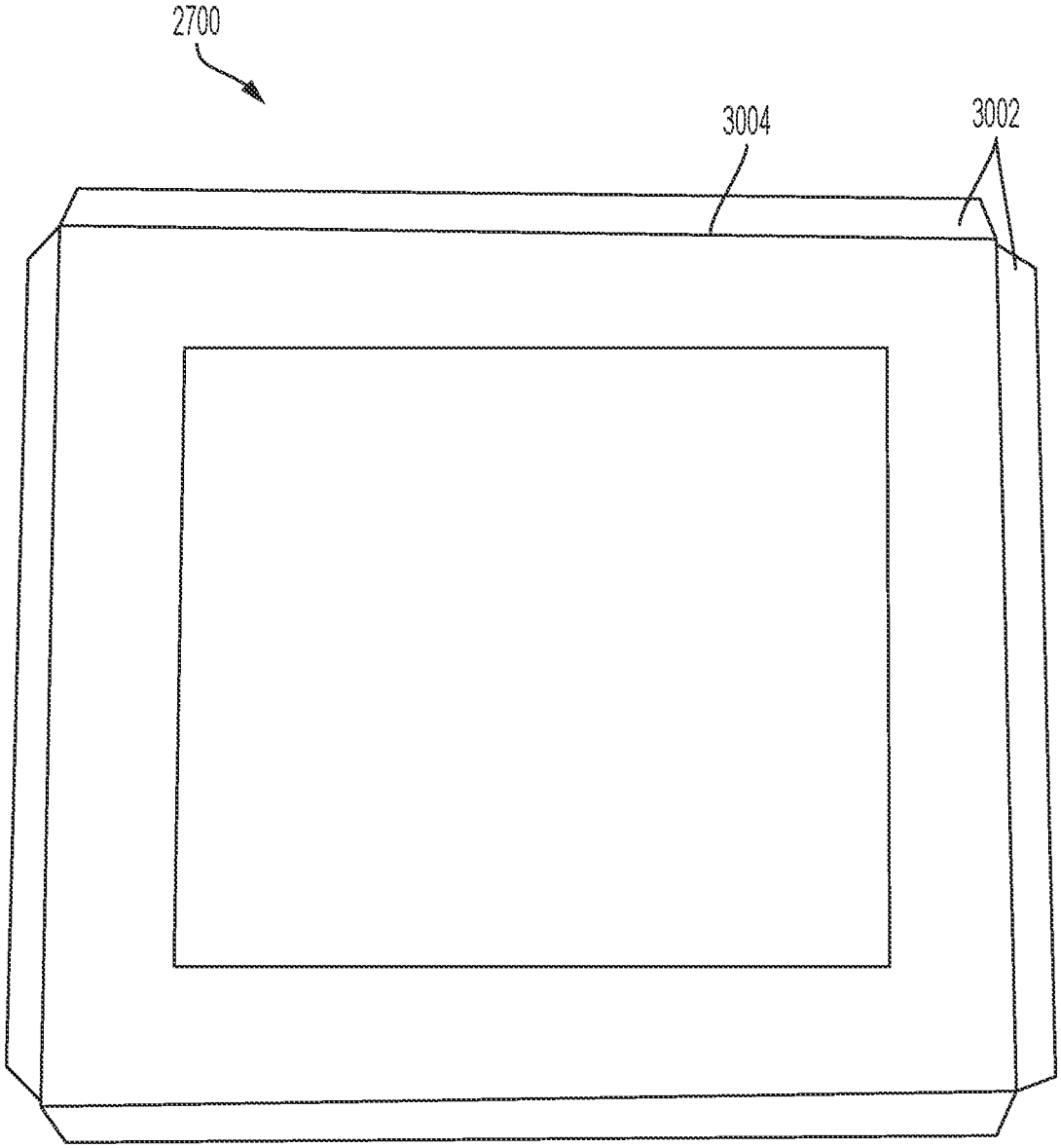
FIG. 30 is a top view of a support ring with foldable edges, according to various alternative embodiments described herein.
Figure 31:
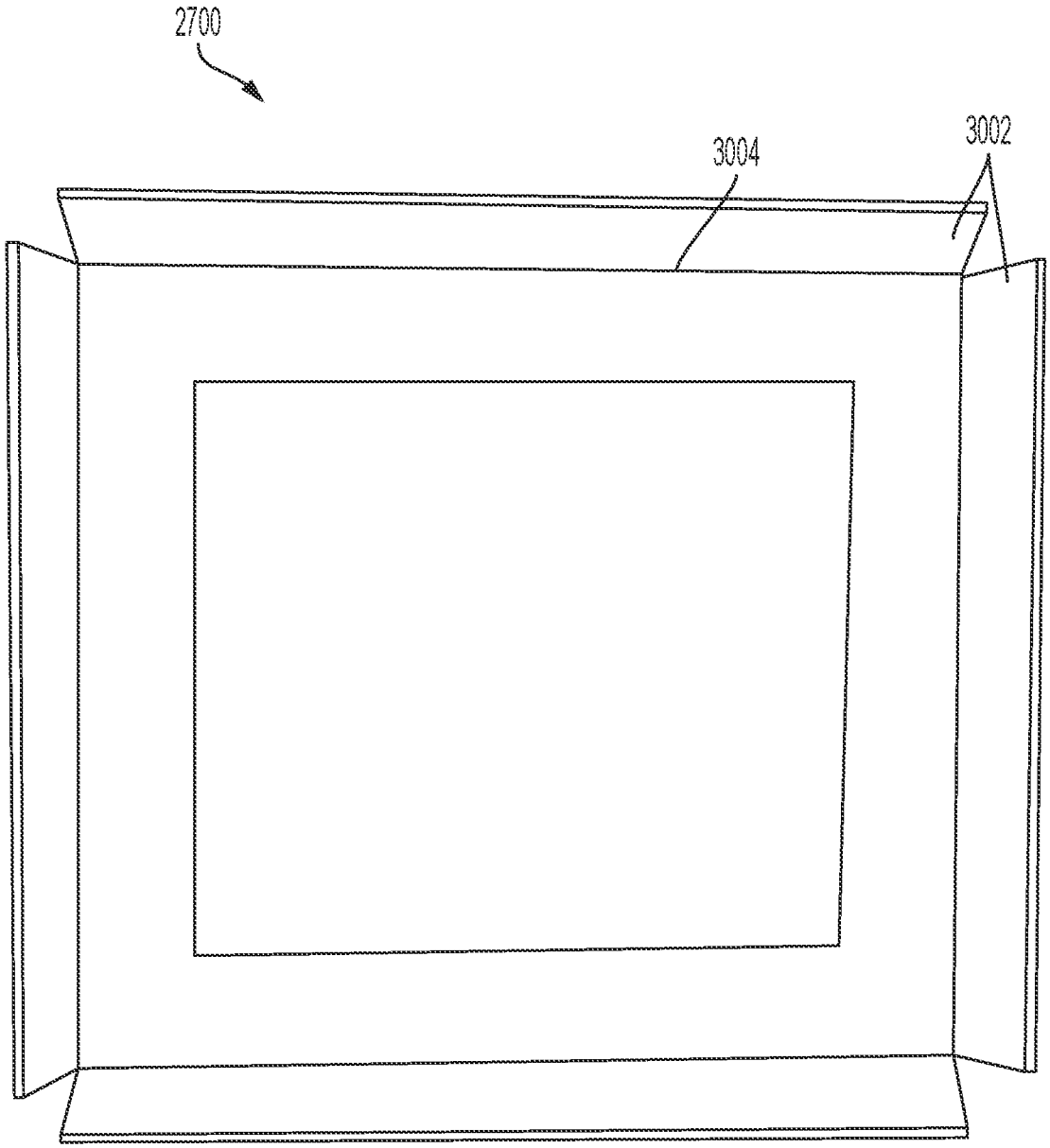
FIG. 31 is a bottom view of the support ring with foldable edges of FIG. 30, according to various alternative embodiments described herein.

FIGS. 30 and 31 show top and bottom views, respectively, of an alternative embodiment of the support ring 2700. According to this embodiment, the support ring 2700 includes a plurality of foldable edges 3002. The foldable edges 3002 are configured to fold around the rim 2800 of the tray container to couple, or assist in coupling, the support ring 2700 to the rim 2800. The foldable edges 3002 are contiguous with the support ring 2700, being cut from the same piece of material. The foldable edges rotate around fold lines 3004, which may include a cut or perforation through a portion of the thickness of the support ring material to facilitate folding of the edges.

Figure 32:
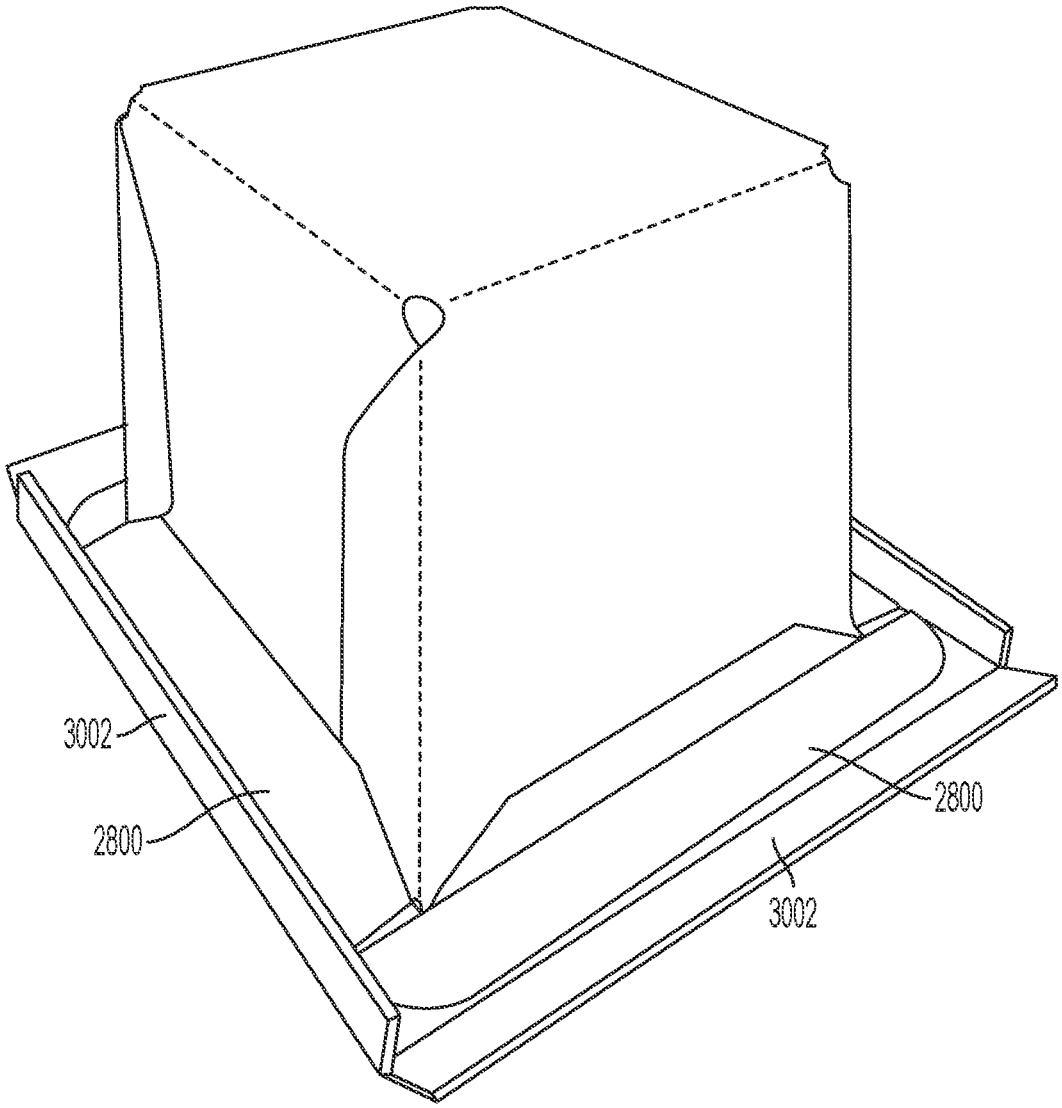
FIG. 32 is a bottom perspective view of a support ring partially secured to a tray container, according to various alternative embodiments described herein.
Figure 33:
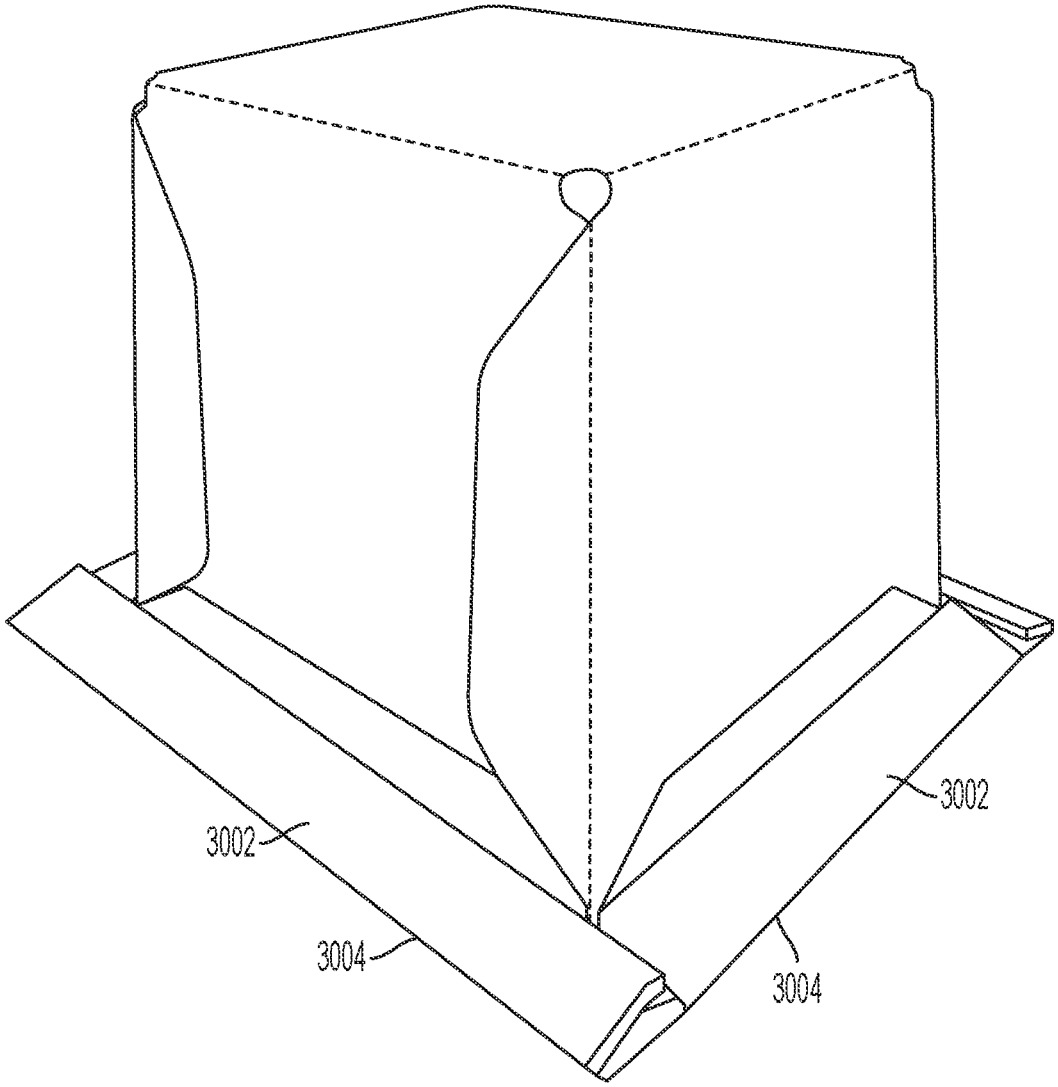
FIG. 33 is a bottom perspective view of the support ring of FIG. 32 fully secured to the tray container, according to various alternative embodiments described herein.

FIG. 32 shows an example in which the foldable edges 3002 are partially folded around the rim 2800. In FIG. 33, the foldable edges 3002 are fully folded or wrapped around the rim 2800 of the tray container to fully secure the support ring 2700 in position for receiving a cover. As described above with respect to a support ring 2700 having top and/or bottom surfaces pre-coated or otherwise treated for bonding, the foldable edges 3002 and/or the rim 2800 may be pre-coated or otherwise treated for securing the support ring and the rim 2800 together.

It should be clear from the disclosure herein that the concepts shown and described allow for a paper-based tray container that has reinforced portions for structural rigidity, including a two-layered perimeter bonding surface that sufficiently strong enough to accommodate an adhesive bonding process of a film or mesh cover to the tray container. The resulting tray container 100 is inexpensive to create, environmentally friendly, structurally sufficient to be filled with fruit or vegetables, strong enough to be stacked and transported after being filled, and capable of receiving and supporting a film or mesh cover, while maximizing and preserving the freshness of the product stored within with adequate ventilation.

CONCLUSION

Many modifications and other embodiments of the disclosure will come to mind to one skilled in the art to which this disclosure pertains having the benefit of the teachings presented in the foregoing descriptions and the associated drawings. For example, as will be understood by one skilled in the relevant field in light of this disclosure, the disclosure may take form in a variety of different mechanical and operational configurations. Therefore, it is to be understood that the disclosure is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

It should be understood that, although various advantages or features of particular aspects of various embodiments are described above, it should be understood that alternative embodiments of the claimed invention may or may not have one or more of the stated advantages described herein.

What is claimed:

1. A tray container, comprising:

a paper-based material foldable from an unassembled configuration that is substantially flat to an assembled configuration defining an interior space;

a container bottom formed from the paper-based material;

a plurality of container sides formed from the paper-based material, each container side having a proximal end contiguous with the container bottom and a distal end configured to fold into a bonding surface and reinforced portion, the bonding surface and the reinforced portion each comprising two layers of the paper-based material, wherein the plurality of container sides comprises:

a first side;

a second side opposite the first side;

a third side positioned between the first side and the second side; and a fourth side opposite the third side and positioned between the first side and the second side;

a perimeter bonding surface comprising each bonding surface of the plurality of container sides;

a support ring configured for attachment to the perimeter bonding surface when the container material is folded in the assembled configuration, the support ring defining a cover bonding surface to which a cover may be bonded, wherein the container material comprises a first contiguous material and the support ring comprises a second contiguous material; and a cover bonded to the cover bonding surface of the support ring, and wherein:

the support ring comprises an inner perimeter and an outer perimeter, the distance between the inner perimeter and the outer perimeter defining a support ring width, wherein the support ring width is larger than a width of the perimeter bonding surface; and the support ring further comprises a plurality of foldable edges, each foldable edge configured to fold around a bonding surface of a corresponding container side such that the support ring abuts a top side and a bottom side of the perimeter bonding surface.

2. The tray container of claim 1, wherein the first side and the second side each comprise a foldable edge tab on each opposite vertically oriented edge, each foldable tab configured to fold inward toward the interior space of the tray container for bonding to an exterior surface of the third side or the fourth side.

3. The tray container of claim 1, wherein each reinforced portion of each container side is formed by folding the distal end of the container side approximately 180 degrees outward away from the interior space and bonding the distal end to an exterior surface of the container side to create a 2-layer portion.

4. The tray container of claim 3, wherein each bonding surface of each container side is formed by folding the 2-layer portion outward away from the interior space between approximately 45-85 degrees to create a bonding surface defining a bonding surface plane that is approximately parallel to a bottom plane defined by the container bottom.

* * * * *